US006580407B1

(12) United States Patent
Suzuki et al.

(10) Patent No.: US 6,580,407 B1
(45) **Date of Patent: *Jun. 17, 2003**

(54) ELECTRON-BEAM GENERATING DEVICE HAVING PLURALITY OF COLD CATHODE ELEMENTS, METHOD OF DRIVING SAID DEVICE AND IMAGE FORMING APPARATUS APPLYING SAME

(75) Inventors: Noritake Suzuki, Atsugi (JP); Hidetoshi Suzuki, Fujisawa (JP); Akira Asai, Atsugi (JP); Akihiko Yamano, Sagamihara (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 70 days.

(21) Appl. No.: 09/496,415

(22) Filed: Mar. 23, 1998

Related U.S. Application Data

(63) Continuation of application No. 08/469,680, filed on Jun. 6, 1995, now Pat. No. 5,734,361.

(30) Foreign Application Priority Data

| | | |
|---|---|---|
| Jun. 8, 1994 | (JP) | 6-126386 |
| Jan. 9, 1995 | (JP) | 7-001226 |
| Jan. 9, 1995 | (JP) | 7-001227 |
| Feb. 6, 1995 | (JP) | 7-136986 |

(51) Int. Cl.[7] ..... G09G 3/22

(52) U.S. Cl. ..... 345/74.1; 313/309; 315/169.1

(58) Field of Search ..... 345/74.1, 75; 313/309, 313/326, 366, 495; 315/169.1

(56) References Cited

U.S. PATENT DOCUMENTS

| | | | |
|---|---|---|---|
| 3,743,879 A | 7/1973 | Kupsky | 315/169.1 |
| 3,872,352 A | 3/1975 | Sasaki et al. | 345/74 |
| 3,872,464 A | 3/1975 | Sasaki et al. | 345/74 |
| 3,890,609 A | 6/1975 | Sasaki et al. | 345/65 |
| 4,525,653 A | 6/1985 | Smith | 315/366 |

(List continued on next page.)

FOREIGN PATENT DOCUMENTS

| | | |
|---|---|---|
| EP | 0 299 461 | 1/1989 |
| EP | 0 434 033 | 6/1991 |
| EP | 0 536 732 | 4/1993 |
| EP | 0 573 754 | 12/1993 |
| EP | 0 592 201 | 4/1994 |

(List continued on next page.)

OTHER PUBLICATIONS

M.I. Elinson, et al., "The Emission of Hot Electrons and the Field Emission of Electrons From Tin Oxide", Radio Eng. Electron Phys., 10, pp. 1290–1296 (1965).

(List continued on next page.)

*Primary Examiner*—Amare Mengistu
(74) *Attorney, Agent, or Firm*—Fitzpatrick, Cella, Harper & Scinto

(57) ABSTRACT

An electron-beam generating device, in which a number of cold cathode elements are matrix-wired, as well as a method of driving the device, is applied to an image forming apparatus. Statistical calculations are performed in advance with regard to a required electron-beam output, and loss produced in the matrix wiring is analyzed. Drive signals are corrected by deciding optimum correction values based upon the analytical results. As a result, when rows of the matrix are driven successively row by row, the intensity of the outputted electron beams can made accurate for any driving pattern.

14 Claims, 30 Drawing Sheets

U.S. PATENT DOCUMENTS

| | | | | | |
|---|---|---|---|---|---|
| 4,904,895 | A | | 2/1990 | Tsukamoto et al. | 313/336 |
| 5,701,134 | A | * | 5/1990 | Lambert et al. | 345/74 |
| 4,958,104 | A | | 9/1990 | Suzuki et al. | 313/495 |
| 4,973,888 | A | | 11/1990 | Morimoto et al. | 315/366 |
| 5,010,326 | A | | 4/1991 | Yamazaki et al. | 340/784 |
| 5,066,883 | A | | 11/1991 | Yoshioka et al. | 313/309 |
| 5,119,085 | A | | 6/1992 | Yamazaki | 340/784 |
| 5,151,690 | A | | 9/1992 | Yamazaki | 340/784 |
| 5,159,326 | A | | 10/1992 | Yamazaki et al. | 340/784 |
| 5,175,535 | A | | 12/1992 | Yamazaki et al. | 340/784 |
| 5,179,371 | A | | 1/1993 | Yamazaki | 340/784 |
| 5,184,118 | A | | 2/1993 | Yamazaki | 340/784 |
| 5,185,554 | A | | 2/1993 | Nomura et al. | 313/495 |
| 5,202,676 | A | | 4/1993 | Yamazaki | 340/784 |
| 5,214,417 | A | | 5/1993 | Yamazaki | 340/784 |
| 5,246,637 | A | | 9/1993 | Matsuura et al. | 264/22 |
| 5,298,914 | A | | 3/1994 | Yamazaki | 345/103 |
| 5,347,201 | A | | 9/1994 | Liang et al. | 315/366 |
| 5,347,292 | A | | 9/1994 | Ge et al. | 345/74 |
| 5,442,370 | A | | 8/1995 | Yamazaki et al. | 345/94 |
| 5,455,597 | A | | 10/1995 | Nakamura et al. | 345/75 |
| 5,489,817 | A | | 2/1996 | Muller et al. | 345/75 |
| 5,627,436 | A | | 5/1997 | Suzuki et al. | 315/169.1 |
| 5,654,607 | A | | 8/1997 | Yamaguchi et al. | 313/495 |
| 5,659,328 | A | | 8/1997 | Todokoro et al. | 345/74 |
| 5,734,361 | A | * | 3/1998 | Suzuki et al. | 313/309 |
| 6,121,942 | A | * | 9/2000 | Sanou et al. | 313/495 |
| 6,231,412 | B1 | * | 5/2001 | Kawade et al. | 445/3 |
| 6,262,701 | B1 | * | 7/2001 | Okuda et al. | 345/74.1 |

FOREIGN PATENT DOCUMENTS

| | | | |
|---|---|---|---|
| EP | 0 596 242 | | 5/1994 |
| EP | 0 619 595 | | 10/1994 |
| JP | 58-224120 | * | 6/1982 |
| JP | 64-31332 | | 2/1989 |
| JP | 2-91687 | | 3/1990 |
| JP | 2-244024 | | 9/1990 |
| JP | 2-257551 | | 10/1990 |
| JP | 2-257553 | | 10/1990 |
| JP | 3-55738 | | 3/1991 |
| JP | 3-189621 | | 8/1991 |
| JP | 4-28137 | | 1/1992 |
| JP | 4-46386 | | 2/1992 |
| JP | 4-118625 | | 4/1992 |
| JP | 4-326392 | | 11/1992 |
| JP | 4-329592 | | 11/1992 |
| JP | 5-232448 | | 9/1993 |
| JP | 5-242793 | | 9/1993 |
| JP | 6-67619 | | 3/1994 |

OTHER PUBLICATIONS

G. Dittmer, "Electrical Conduction and Electron Emission of Discontinuous Thin Films", Thin Solid Films, 9, pp. 317–328 (1982).

M. Hartwell, et al., "Strong Electron Emission From Patterned Tin–Indium Oxide Thin Films", IEEE Trans. E.D. Conf., 519 (1975).

H. Araki, et al., "Electroforming and Electron Emission of Carbon Thin Films", Shinkuu, vol. 26, No. 1, pp. 22–29 (1983).

W.P. Dyke, et al., "Field Emission", Advance in Electron Physics, 8, pp. 89–185 (1956).

C.A. Spindt, et al., "Physical Properties of Thin–Film Field Emission Cathodes With Molybdenum Cones", Journal of Applied Physics, vol. 47, No. 12, pp. 5248–5263 (Dec. 1976).

C.A. Mead, "Operation of Tunnel–Emission Devices", Journal of Applied Physics, vol. 32, No. 4, pp. 646–652 (Apr. 1961).

R. Meyer, "Recent Development on "Microtips" Display at LETI", Technical Digest of 4th Int. Vacuum Microelectronics Conf., Nagahara, pp. 6–9 (1991).

* cited by examiner

ROW DIRECTION (DESIRED LUMINANCE)
1 2 3 4 n
0 0 0 0 0 0 0 0 0 255

(DISPLAYED LUMINANCE)
ROW NO. 1
0 0 0 0 0 0 0 0 0 255
P (DISPLAYED LUMINANCE)
ROW NO. 1024
0 0 0 0 0 0 0 0 0 255
P
ROW DIRECTION (DESIRED LUMINANCE)
1 2 3 4 n
0 0 0 0 0 255 255 255 255 255

(DISPLAYED LUMINANCE)
ROW NO. 1
0 0 0 0 0 253 251 250 249 249
P (DISPLAYED LUMINANCE)
ROW NO. 1024
0 0 0 0 0 253 251 250 249 249
P
ROW DIRECTION (DESIRED LUMINANCE)
1 2 3 4 n
255 255 255 255 255 255 255 255 255 255

(DISPLAYED LUMINANCE)
ROW NO. 1
252 250 248 247 246 245 245 244 244 244
P (DISPLAYED LUMINANCE)
ROW NO. 1024
252 250 248 247 246 245 245 244 244 244
P

DXm : SELECTED ROW
DX1~DXm-1 : UNSELECTED ROWS

FIG. 33

$$\begin{bmatrix} V1 \\ V2 \\ V3 \\ \cdots \\ Vn \end{bmatrix} = rx \bullet \begin{bmatrix} 1 & 1 & 1 & 1 & \cdots & 1 \\ 1 & 2 & 2 & 2 & \cdots & 2 \\ 1 & 2 & 3 & 3 & \cdots & 3 \\ \cdots & \cdots & \cdots & \cdots & \cdots & \cdots \\ 1 & 3 & 4 & 4 & \cdots & n \end{bmatrix} \bullet \begin{bmatrix} I1 \\ I2 \\ I3 \\ \cdots \\ In \end{bmatrix} + Ra \bullet (I1 + I2 + \cdots In) \bullet \begin{bmatrix} 1 \\ 1 \\ 1 \\ \cdots \\ 1 \end{bmatrix} + (Rb + j \bullet ry) \bullet \begin{bmatrix} I1 \\ I2 \\ I3 \\ \cdots \\ In \end{bmatrix}$$

ELECTRON-BEAM GENERATING DEVICE HAVING PLURALITY OF COLD CATHODE ELEMENTS, METHOD OF DRIVING SAID DEVICE AND IMAGE FORMING APPARATUS APPLYING SAME

This application is a continuation of Ser. No. 08/469,680 filed Jun. 6, 1995, now U.S. Pat. No. 5,734,361.

BACKGROUND OF THE INVENTION

1. Field of the Invention

This invention relates to an electron-beam generating device having a plurality of matrix-wired cold cathode elements and to a method of driving the device. The invention further relates to an image forming apparatus to which the electron-beam generating device is applied, particularly a display apparatus using phosphors as image forming members.

2. Description of the Related Art

Two types of elements, namely thermionic cathode elements and cold cathode elements, are known as electron emission elements. Examples of cold cathode elements are surface-conduction electron emission elements, electron emission elements of the field emission type (abbreviated to "FE" below) and metal/insulator/metal type (abbreviated to "MIM" below).

An example of the surface-conduction electron emission element is described by M. I. Elinson, Radio. Eng. Electron Phys., 10, 1290, (1965).

There other examples as well, as will be described later.

The surface-conduction electron emission element makes use of a phenomenon in which an electron emission is produced in a small-area thin film, which has been formed on a substrate, by passing a current parallel to the film surface. Various examples of this surface-conduction electron emission element have been reported. One relies upon a thin film of $SnO_2$ according to Ellinson, mentioned above. Other examples use a thin film of Au [G. Dittmer: "Thin Solid Films", 9.317 (1972)]; a thin film of $In_2O_3/SnO_2$ (M. Hartwell and C. G. Fonstad: "IEEE Trans. E.D. Conf.", 519 (1975); and a thin film of carbon (Hisashi Araki, et al: "Shinkuu", Vol. 26, No. 1, p. 22 (1983).

FIG. 1 is a plan view of the element according to M. Hartwell, et al., described above. This element construction is typical of these surface-conduction electron emission elements. As shown in FIG. 1, numeral 3001 denotes a substrate. Numeral 3004 denotes an electrically conductive thin film comprising a metal oxide formed by sputtering. The conductive film 3004 is subjected to an electrification process referred to as "energization forming", described below, whereby an electron emission portion 3005 is formed. The spacing L in FIG. 1 is set to 0.5~1 mm, and the spacing W is set to 0.1 mm. For the sake of illustrative convenience, the electron emission portion 3005 is shown to have a rectangular shape at the center of the conductive film 3004. However, this is merely a schematic view and the actual position and shape of the electron emission portion are not represented faithfully here.

In the above-mentioned conventional surface-conduction electron emission elements, especially the element according to Hartwell, et al., generally the electron emission portion 3005 is formed on the conductive thin film 3004 by the so-called "energization forming" process before electron emission is performed. According to the forming process, a constant DC voltage or a DC voltage which rises at a very slow rate on the order of 1 V/min is impressed across the conductive thin film 3004 to pass a current through the film, thereby locally destroying, deforming or changing the property of the conductive thin film 3004 and forming the electron emission portion 3005, the electrical resistance of which is very high. A fissure is produced in part of the conductive thin film 3004 that has been locally destroyed, deformed or changed in property. Electrons are emitted from the vicinity of the fissure if a suitable voltage is applied to the conductive thin film 3004 after energization forming.

Known examples of the FE type are described in W. P. Dyke and W. W. Dolan, "Field emission", Advance in Electron Physics, 8,89 (1956), and in C. A. Spindt, "Physical properties of thin-film field emission cathodes with molybdenum cones", J. Appl. Phys., 47, 5248 (1976).

A typical example of the construction of an FE-type element is shown in FIG. 2, which is a sectional view of the element according to Spindt, et al., described above. The element includes a substrate 3010, emitter wiring 3011 comprising an electrically conductive material, an emitter cone 3012, an insulating layer 3013 and a gate electrode 3014. The element is caused to produce a field emission from the tip of the emitter cone 3012 by applying an appropriate voltage across the emitter cone 3012 and gate electrode 3014.

In another example of the construction of an FE-type element, the stacked structure of the kind shown in FIG. 2 is not used. Rather, the emitter and gate electrode are arranged on the substrate in a state substantially parallel to the plane of the substrate.

A known example of the MIM type is described by C. A. Mead, "Operation of tunnel emission devices", J. Appl. Phys., 32, 646 (1961). FIG. 3 is a sectional view illustrating a typical example of the construction of the MIM-type element. The element includes a substrate 3020, a lower electrode 3021 consisting of a metal, a thin insulating layer 3022 having a thickness on the order of 100 Å, and an upper electrode 3023 consisting of a metal and having a thickness on the order of 80~300 Å. The element is caused to produce a field emission from the surface of the upper electrode 3023 by applying an appropriate voltage across the upper electrode 3023 and lower electrode 3021.

Since the above-mentioned cold cathode element makes it possible to obtain an electron emission at a lower temperature in comparison with a thermionic cathode element, a heater for applying heat is unnecessary. Accordingly, the structure is simpler than that of the thermionic cathode element and it is possible to fabricate elements that are finer. Further, even though a large number of elements are arranged on a substrate at a high density, problems such as fusing of the substrate do not readily arise. In addition, the cold cathode element differs from the thermionic cathode element in that the latter has a slow response speed because it is operated by heat produced by a heater. Thus, an advantage of the cold cathode element is a quicker response speed.

For these reasons, extensive research into applications for cold cathode elements is being carried out.

By way of example, among the various cold cathode elements, the surface-conduction electron emission element is particularly simple in structure and easy to manufacture and therefore is advantageous in that a large number of elements can be formed over a large area. Accordingly, research has been directed to a method of arraying and driving a large number of elements, as disclosed in Japanese Patent Application Laid-Open No. 64-31332, filed by the applicant.

Further, applications of surface-conduction electron emission elements that have been researched are image forming apparatus such as image display apparatus and image recording apparatus, charged beam sources, etc.

As for applications to image display apparatus, research has been conducted with regard to such an apparatus using, in combination, surface-conduction type electron emission elements and phosphors which emit light in response to irradiation with an electron beam, as disclosed, for example, in the specifications of U.S. Pat. No. 5,066,883 and Japanese Patent Application Laid-Open (KOKAI) Nos. 2-257551 and 4-28137 filed by the present applicant. The image display apparatus using the combination of the surface-conduction type electron emission elements and phosphors is expected to have characteristics superior to those of the conventional image display apparatus of other types. For example, in comparison with a liquid-crystal display apparatus that have become so popular in recent years, the above-mentioned image display apparatus emits its own light and therefore does not require back-lighting. It also has a wider viewing angle.

A method of driving a number of FE-type elements in a row is disclosed, for example, in the specification of U.S. Pat. No. 4,904,895 filed by the present applicant. A flat-type display apparatus reported by Meter et al., for example, is known as an example of an application of an FE-type element to an image display apparatus. [R. Meyer: "Recent Development on Microtips Display at LETI", Tech. Digest of 4th Int. Vacuum Microelectronics Conf., Nagahara, pp. 6~9, (1991).]

An example in which a number of MIM-type elements are arrayed in a row and applied to an image display apparatus is disclosed in the specification of Japanese Patent Application Laid-Open No. 3-55738 filed by the present applicant.

Under these circumstances, the inventors have conducted exhaustive research with regard to multiple electron source. FIG. 4 shows an example of a method of wiring a multiple electron source. In FIG. 2, a total of n×m cold cathode elements are wired two-dimensionally in matrix form, with m-number of elements arrayed in the vertical direction and n-number in the horizontal direction. In FIG. 4, numeral 3074 denotes a cold cathode element, 3072 row-direction wiring, 3073 column-direction wiring, 3075 wiring resistance of the row-direction wiring 3072 and 3076 wiring resistance of the column-direction wiring 3073. Further, Dx1, Dx2, . . . Dxm represent feed terminals for the row-direction wiring. Further, Dy1, Dy2, . . . Dym represent feed terminals for the column-direction wiring. This simple wiring method is referred to as a "matrix wiring method". Since the matrix wiring method involves a simple structure, fabrication is easy.

In a case where a multiple electron beam source constructed using the matrix wiring method is applied to an image display apparatus, it is preferred that m and n each be a number of several hundred or more in order to assure display capacity. In addition, it is required that an electron beam of desired intensity be capable of being produced from each cold cathode element in order to display an image at a correct luminance.

In a case where a large number of matrix-wired cold cathode elements are driven in the prior art, the method adopted is to drive the group of elements on one row of the matrix simultaneously. Rows driven are successively changed over one by one so that all rows are scanned. In accordance with this method, drive time allocated to each element is lengthened by a factor of n in comparison with the method of scanning all elements successively one element at a time, thus making it possible to raise the luminance of the display apparatus.

However, when a matrix-wired multiple electron beam source is actually driven by the above-described drive method, a problem which arises is that the intensity of the electron beam outputted from each cold cathode element deviates from the desired value. This results in unevenness or fluctuation in the luminance of the display image and, hence, a decline in picture quality.

This problem will be described in greater detail with reference to FIGS. 5A~7B. In order to avoid overly complicated drawings, FIGS. 5A~7A illustrate only one row (n pixels) of the m×n pixels. Each pixel is provided to correspond to a respective cold cathode element. The farther to the right the position is taken, the more distant the position is from the feed terminal Dx of the line wiring 3072. For the sake of simplifying the description, luminance levels are represented by numerical values, the maximum value is 255, the minimum value is 0 and the intermediate values grow successively larger by 1.

FIG. 5A illustrates an example of a desired display pattern, in which it is desired that only the right-most pixel be made to emit light at the luminance 255. FIG. 5B illustrates measurement of the luminance of an image displayed by actually driving the cold cathode elements.

FIG. 6A illustrates another example of a desired displayed pattern, in which it is desired that the group of pixels on the left half of the row be made to emit no light (luminance 0) and that the group of pixels on the right half of the row be made to emit light at luminance 255. FIG. 6B illustrates measurement of the luminance of an image displayed by actually driving the cold cathode elements.

FIG. 7A illustrates another example of a desired displayed pattern, in which it is desired that all pixels of the row be made to emit light at luminance 255. FIG. 7B illustrates measurement of the luminance of an image displayed by actually driving the cold cathode elements.

Thus, as evident from these examples, the luminance of the actually display image deviates from the desired luminance. Moreover, if attention is directed toward the pixel indicated by arrow P in these Figures, it will be apparent that the magnitude of the deviation from the desired luminance is not necessarily constant.

SUMMARY OF THE INVENTION

Accordingly, an object of the present invention is to obtain a correct intensity for the electron beams produced by a multiple electron beam source having matrix-wired cold cathode elements, and to prevent a deviation in the display luminance of an image display apparatus.

When a plurality of matrix-wired cold cathode elements are driven simultaneously in one row, the drive currents in the row (=n elements) merge in the row wiring of this row. Since the junction at which merging takes place differs for each cold cathode element, there are a total of n-number of junctions on one row wire. Though the drive current which flows into each cold cathode element differs in dependence upon the desired electron-beam output value, the drive currents merge at different points so that the current which flows into each portion of the row wire is not uniform, depending upon the location. Accordingly, loss (voltage drop) produced by the electrical resistance 3075 at each portion of the row wire also is not uniform, depending upon the location. Though each cold cathode element is influenced by this loss, the manner in which this influence is received differs for each element depending upon the position at which each element is connected to the row wire. What is noteworthy here is that the loss (voltage drop) which has an influence upon a certain cold cathode element is contributed to by the drive currents of the other cold cathode elements in the same row.

In the prior art, the electron beam outputted by a cold cathode element deviates from the desired intensity owing to the loss (voltage drop) produced in each portion of the row wire. In accordance with the present invention, however, a correction is applied to the drive signals upon analyzing loss in advance. As a result, the intensity of an outputted electron beam exhibits almost no deviation from the desired value. In particular, according to the invention, loss (voltage drop) produced in row wiring is analyzed with high precision by statistically quantifying the desired output intensity of all cold cathode elements in the row. This makes highly accurate correction possible.

More specifically, according to the present invention, the foregoing object is attained by providing an electron-beam generating device comprising: a plurality of cold cathode elements arrayed in the form of rows and columns on a substrate; m-number of row wires and n-number of column wires for wiring the plurality of cold cathode elements into a matrix; and drive signal generating means for generating signals which drive the plurality of cold cathode elements. The drive signal generating means includes statistic quantity calculating means for performing a statistical calculation with regard to the externally entered electron-beam demand values, correction-value generating means for generating correction values on the basis of results of calculation by the statistic-quantity calculating means, combining means for combining the externally entered electron-beam demand values, and the correction values and means for successively driving the matrix-wired cold cathode elements on the basis of an output value from the combining means.

The present invention further provides a method of driving an electron-beam generating device having a plurality of cold cathode elements arrayed in the form of rows and columns on a substrate, as well as m-number of row wires and n-number of column wires for wiring the plurality of cold cathode elements into a matrix. The drive method comprises a statistic calculating step of performing a statistical calculation with regard to the externally entered electron-beam demand information; a correction-value generating step of generating correction values on the basis of results of calculation at the statistic calculating step; a combining step of combining the externally entered electron-beam demand values and the correction values; and a step of successively driving, row by row, the matrix-wired cold cathode elements on the basis of combined results obtained at the combining step.

In accordance with the device or drive method described above, a statistical operation is performed with regard to the electron-beam demand values and a correction is applied based upon the results of the operation. Even if the required electron-beam output pattern changes, therefore, a correction suited to the changed pattern can be applied.

In the electron-beam generating device of the present invention, the statistic-quantity calculating means includes means for calculating a sum total of one row of electron-beam demand values with regard to the externally entered electron-beam demand values.

In the drive method of the present invention, the statistic-quantity calculating step includes a step of calculating a sum total of one row of electron-beam demand values with regard to the externally entered electron-beam demand information.

In accordance with the device or drive method described above, the sum total of one row of electron-beam demand values can be ascertained, and therefore it is possible to ascertain the sum total of drive currents when the elements on one row are driven simultaneously. As a result, a correction conforming to the sum total of one row can be performed when the elements in one row are driven simultaneously.

In the electron-beam generating device of the present invention, the correction-value generating means includes means for calculating a current, which will flow into the row wires and column wires at the time of drive, on the basis of results of calculation by the statistic-quantity calculating means and output characteristic of the cold cathode elements, analyzing amount of electrical loss due to wiring resistance, deciding amount of correction for compensating for the loss and outputting the amount of correction.

In the electron-beam generating method of the present invention, the correction-value generating step includes a step of calculating a current, which will flow into the row wires and column wires at the time of drive, on the basis of results of calculation at the statistic calculating step and output characteristic of the cold cathode elements, analyzing amount of electrical loss due to wiring resistance, deciding amount of correction for compensating for the loss and outputting the amount of correction.

In accordance with the device or drive method described above, the current which flows into a row wire and a column wire at the time of drive is calculated based upon the output characteristic of the cold cathode element, and the amount of loss (voltage drop) ascribable to wiring resistance can be analyzed. Accordingly, a correction voltage necessary to compensate for the voltage drop can be determined accurately and a highly precision correction can be carried out.

In the electron-beam generating device of the present invention, the correction-value generating means includes a look-up table which stores correction quantities predetermined with regard to all cases of results of calculation capable of being outputted by said statistic-quantity calculating means.

The correction quantities stored in the look-up table in advance are correction quantities obtained by calculating a current, which will flow into the row wires and column wires at the time of drive, on the basis of output characteristics of the cold cathode elements with regard to all cases of results of calculation capable of being outputted by the statistic-quantity calculating means, analyzing beforehand the amount of electrical loss due to wiring resistance, and determining the correction quantities in advance based upon results of analysis.

In the electron-beam generating method of the present invention, the correction-value generating step includes a step of reading correction quantities out of a look-up table which stores the correction quantities predetermined with regard to all cases of results of calculation capable of being outputted at the statistic-quantity calculating step.

The correction quantities read out of the look-up table are correction quantities obtained by calculating a current, which will flow into the row wires and column wires at the time of drive, on the basis of output characteristics of the cold cathode elements with regard to all cases of results of calculation capable of being outputted at the statistic-quantity calculating step, analyzing beforehand an amount of electrical loss due to wiring resistance, and determining the correction quantities in advance based upon results of the analysis.

In accordance with the above-mentioned device or drive method, it is unnecessary to calculate a correction value whenever drive is performed.

In the electron-beam generating device of the present invention, the correction-value generating means comprises means for outputting correction quantities V1~Vn calculated in accordance with the equation shown below.

In the drive method of the present invention, the correction-value generating step comprises a step of outputting correction quantities V1~Vn calculated in accordance with the equation shown below.

$$\begin{pmatrix} V1 \\ V2 \\ V3 \\ \vdots \\ Vn \end{pmatrix} = r_x \cdot \begin{pmatrix} 1 & 1 & 1 & 1 & \dots & 1 \\ 1 & 2 & 2 & 2 & \dots & 2 \\ 1 & 2 & 3 & 3 & \dots & 3 \\ \vdots & \vdots & \vdots & \vdots & & \vdots \\ 1 & 2 & 3 & 4 & \dots & n \end{pmatrix} \cdot \begin{pmatrix} I1 \\ I2 \\ I3 \\ \vdots \\ In \end{pmatrix} + Ra \cdot (I1 + I2 + \cdots In) \cdot \begin{pmatrix} 1 \\ 1 \\ 1 \\ \vdots \\ 1 \end{pmatrix} + (Rb + j \cdot r_y) \cdot \begin{pmatrix} I1 \\ I2 \\ I3 \\ \vdots \\ In \end{pmatrix}$$

where the parameters are as follows:

V1~Vn: correction quantities for cold cathode elements of columns 1~n in j-th row;

I1~In: current values, to be passed through column wires of columns 1~n, calculated based upon externally entered electron-beam demand values and electron emission characteristics of cold cathode elements;

Ra: electrical resistance of extracted portion of row wiring;

I1+I2+ . . . +In: sum total of one row of externally entered electron-beam demand values (namely results of calculation by said statistic calculating means);

Rb: electrical resistance of extracted portion of column wiring;

ry: electrical resistance between cold cathode elements of column wiring;

rx: electrical resistance between cold cathode elements of row wiring;

n: total number of columns of matrix; and j: row number ($1 \leqq j \leqq m$).

In accordance with the above-mentioned device or drive method, an optimum correction quantity for each cold cathode element can be calculated with respect to all combinations of electron-beam demand values. This makes it possible to perform a highly precise correction. Moreover, since the wiring resistance of the column wiring is included as a parameter in the equation, an optimum correction quantity is calculated accordingly even if the row driven is changed.

Further, in the electron-beam generating device of the present invention, the correction-quantity generating means includes a first-in last-out circuit and an adder circuit.

Further, the combining means adds or multiplies together the externally entered electron-beam demand values and correction quantities generated by the correction-value generating means.

Further, in the drive method of the present invention, the correction-quantity generating step includes a step of performing operations using a first-in last-out circuit and an adder circuit.

Further, the combining step includes a step of adding or multiplying together the externally entered electron-beam demand values and correction quantities generated at the correction-value generating step.

In accordance with the above-mentioned device and method, correction values can be calculated accurately and at high speed by a simple circuit arrangement.

In the electron-beam generating device or drive method of the present invention, image information is used as the externally entered electron-beam demand values.

The above-mentioned device or drive method is ideal for use in various image forming apparatus such as an image display apparatus, printer or electron-beam exposure system.

In the electron-beam generating device of the present invention, surface-conduction electron emission elements are used as the cold cathode elements.

The above-mentioned device is simple to manufacture and even a device having a large area can be fabricated with ease.

If the electron-beam generating device of the present invention is combined with an image forming member for forming an image by irradiation with an electron beam outputted by the electron-beam generating device, an image forming apparatus having a high picture quality can be provided.

If the above-mentioned image forming apparatus has phosphors as the image forming members for forming an image by irradiation with the electron beam, an image display apparatus suited to a television or computer terminal can be provided.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 33 shows a mathematical expression used in deciding a correction value;

DESCRIPTION OF THE PREFERRED EMBODIMENTS

Preferred embodiments of the present invention will be described in detail in accordance with the accompanying drawings.

First Embodiment

An image display apparatus which is a first embodiment of the present invention, as well as a method of driving the apparatus, will now be described in detail. The construction and operation of the electrical circuitry will be described first, then the structure and method of manufacturing a display panel and finally the structure and method of manufacturing a cold cathode element incorporated within the display panel.

(Construction and Operation of Electrical Circuitry)

Figure 8:
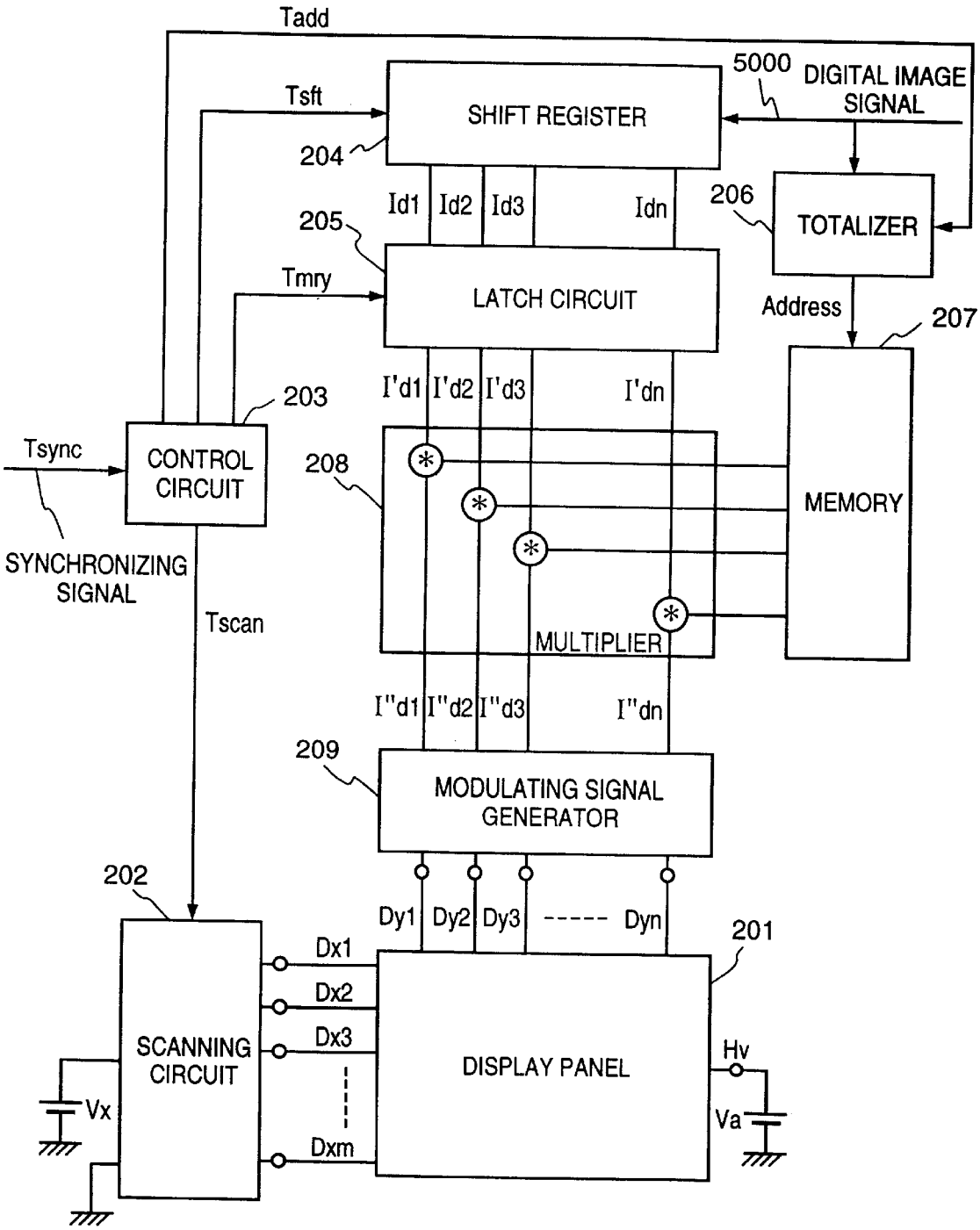
FIG. 8 is a circuit diagram showing the circuit arrangement of a first embodiment of the present invention.

FIG. 8 is a circuit diagram showing the arrangement of the electrical circuitry. Shown in FIG. 8 are a display panel 201, a scanning circuit 202, a control circuit 203, a shift register 204, a latch circuit 205, a totalizer 206, a memory 207, a multiplier 208 and a modulating signal generator 209.

A plurality of cold cathode elements arranged in the form of rows and columns are incorporated within the display panel 201. Dx1~Dxm and Dy1~Dyn represent feed terminals belonging to the m-number of row wires and n-number of column wires, respectively, of matrix wiring.

The totalizer 206 is a concrete example of statistic calculating means, which is a structural element of the present invention. The memory 207 is an example of correction-value generating means, the multiplier 208 is an example of combining means, and the scanning circuit 202 and modulating signal generator 209 constitute an example of means for successively driving rows one row at a time.

Since this embodiment is an image display apparatus, an externally applied image signal is used as electron-beam demand values (values relating to the electron beam output required for each cold cathode element).

The functions of the foregoing units and the procedure of operation will now be described in further detail.

In FIG. 8, the display panel 201 is connected to external electrical circuitry via the feed terminals Dx1~Dxm, terminals Dy1~Dyn. A terminal Hv for feeding current to the phosphors is connected to an external high-voltage power supply Va. Scanning signals for successively driving, one row at a time, the multiple electron beam sources provided within the display panel 201, namely the group of cold cathode elements matrix-wired in the form of an m-row, n-column matrix, are applied to the terminals Dx1~Dxm from the scanning circuit 202. Modulating signals for controlling the output electron beams of the respective elements of the cold cathode elements in a row selected by the scanning signals are applied to the terminals Dy1~Dyn.

The scanning circuit 202 will be described next. The scanning circuit 202 is internally provided with m-number of switching elements. Each switching element selects either the output voltage of a DC voltage source Vx or 0 V (the ground level) and electrically connects the selected voltage to a corresponding one of the terminals Dx1 through Dxm of the display panel 201. In actuality it is possible to readily realize the switching elements by combining switching elements such as FETs, by way of example. It should be noted that the output voltage of the DC voltage source Vx has been set, based upon the characteristic of the cold cathode element (an electron-emission threshold voltage), in such a manner that a drive voltage applied to an element of a row not being scanned will fall below the electron-emission threshold voltage.

On the basis of an image signal that enters from the outside, the control circuit 203 acts to coordinate the operation of each component so as to present an appropriate display. On the basis of a synchronizing signal Tsync, described below, the control circuit 203 generates control signals Tscan, Tsft, Tmry and Tadd applied to the scanning circuit 202, shift register 204, latch circuit 205 and totalizer 206. The synchronizing signal Tsync comprises a vertical synchronizing signal and a horizontal synchronizing signal, as is well known, but is designated by Tsync in the Figure in order to facilitate the description. A digital video signal (luminance component) enters the shift register 204. The shift register 204 is for converting the digital video signal, which enters serially in a time series, to a parallel signal every line of the image. The shift register 204 operates based upon the control signal Tsft sent from the control circuit 203. More specifically, the control signal Tsft is a shift clock serving as a synchronizing signal which successively shifts the digital video signal that enters the shift register 204. The serial/parallel-converted data of one line of the image data (which corresponds to the drive data of n-number of electron emission elements) is outputted from the shift register 204 as n-number of parallel signals Id1~Idn.

The latch circuit 205 holds one line of the image data for a requisite period of time only. The latch circuit 205 latches the contents of Id1~Idn in accordance with the control signal Tmry sent from the control circuit 203. The contents thus stored in the latch circuit 205 are outputted as I'd1~I'dn, which enter the multiplier 208.

The totalizer 206 totals the luminance of one line of the image signal. More specifically, in sync with the clock Tadd sent from the control circuit 203 to the totalizer 206, the totalizer 206 totals the luminance data of the digital video signal of one line and is reset at the end of one line. As a result, the total value of each line is outputted to the correction-rate setting memory 207. Correction-rate data corresponding to the totaled values are stored in the correction-rate selecting memory 207 in advance at addresses conforming to the totaled values from the totalizer 206. Accordingly, corresponding correction-rate data is immediately read out of the memory from an address (totaled value) which has entered from the totalizer 206 and this data can be outputted to the multiplier 208.

Examples of methods of calculating correction-rate data that has been stored in the correction-rate selecting memory 207 will be described with reference to FIGS. 9A~9C and FIGS. 10A~10C.

Let $I_{total1}$ represent the totaled value of luminance of one line, and let n represent the number of cold cathode elements on one line (row) in the display panel 201. The average value $I_{avg1}$ of the luminance signal per element is then expressed as follows:

$$I_{avg1}=I_{total1}/n$$

Figure 9A:
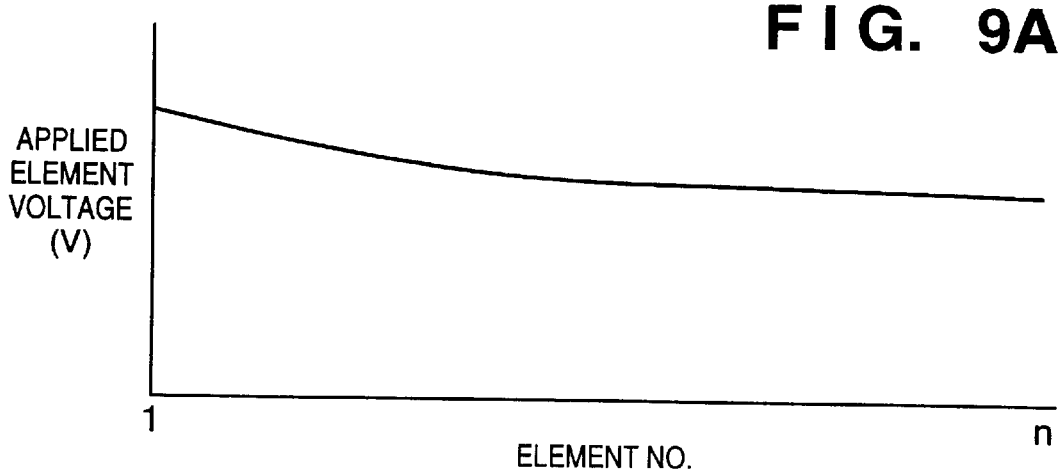
FIGS. 9A~9C are graphs for describing a process for calculating a correction rate.
Figure 9B:
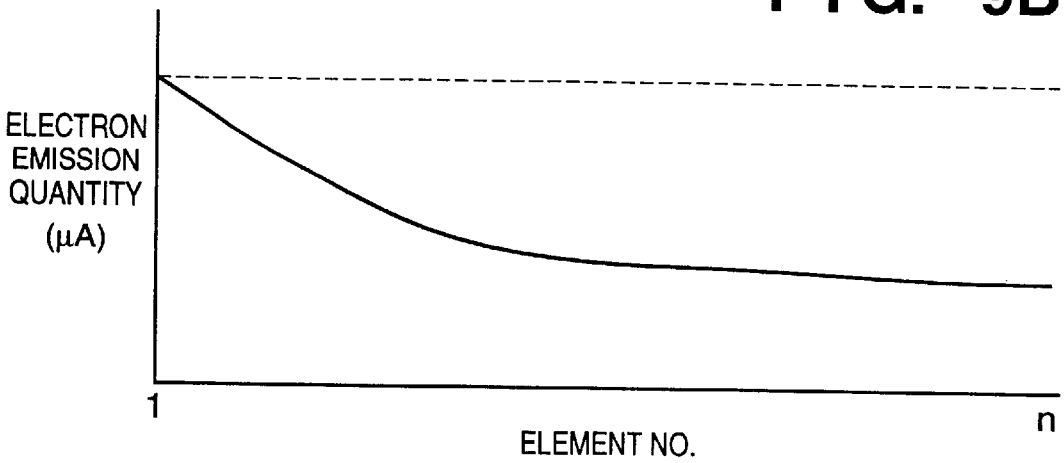
Figure 9C:
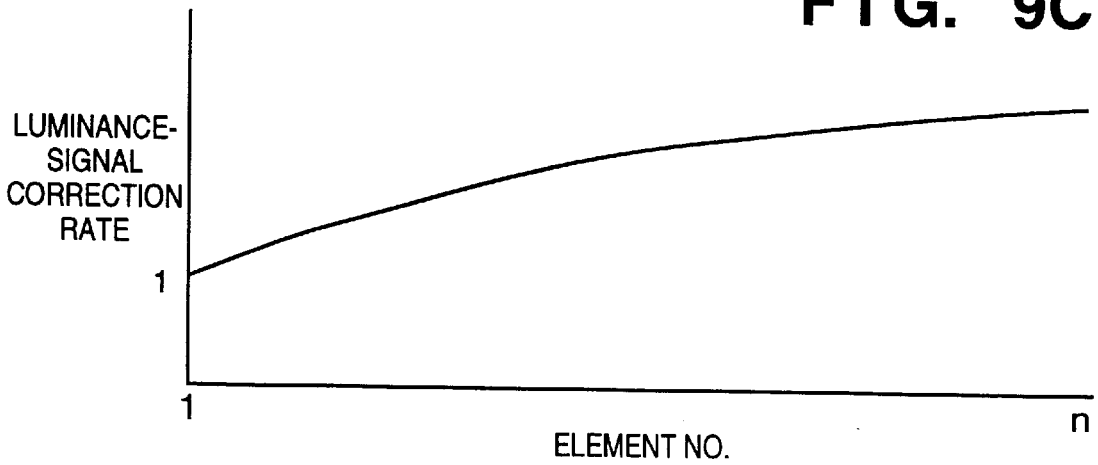

If it is assumed for the sake of simplicity that the luminance signals (gray levels) are all equal to $I_{avg1}$, then the voltage distribution produced at this time will be as shown in FIG. 9A providing that voltage drop of the wiring is taken into account. The corresponding distribution of the electron emission quantities may be predicted to be as shown in FIG. 9B. This is equivalent to a luminance distribution in a case where no correction is applied. Accordingly, the correction rate for correcting this distribution to a constant luminance takes on a value illustrated in the graph of FIG. 9C. Correction becomes possible by multiplying the luminance-component signals I'd1~I'dn by this value in the multiplier 208.

Figure 10A:
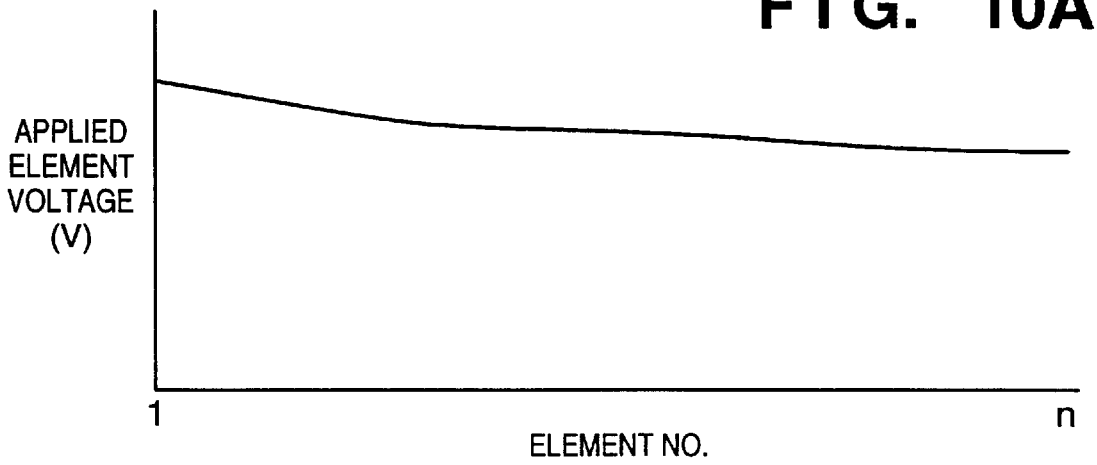
FIGS. 10A~10C are graphs for describing a process for calculating a correction rate.
Figure 10B:
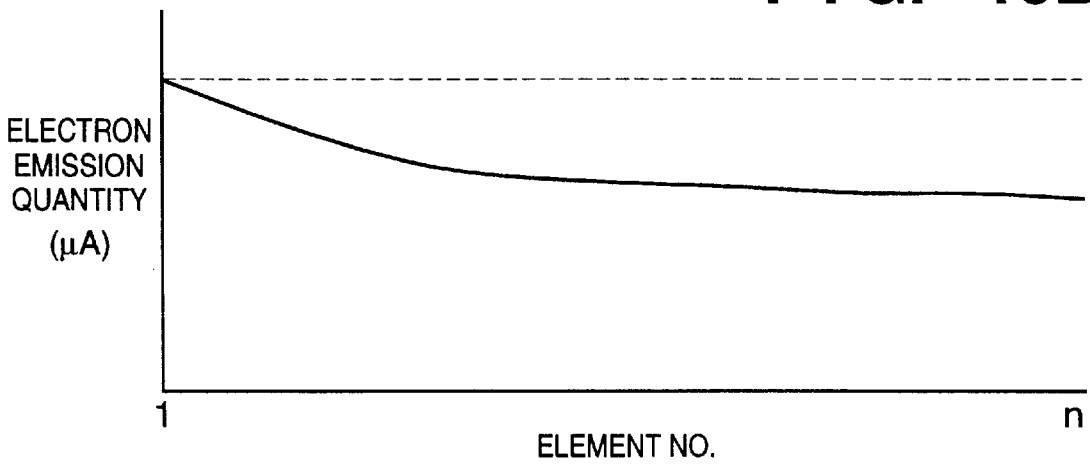
Figure 10C:
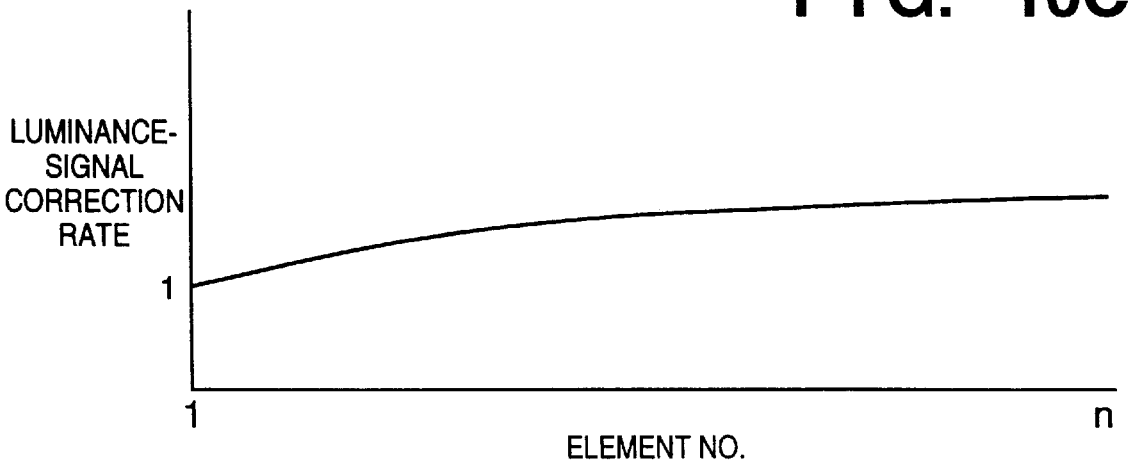

When a totaled value $I_{total2}$ smaller than $I_{total1}$ enters, the predicted voltage distribution is as shown in FIG. 10A. This is small in comparison with $I_{total1}$ shown in FIG. 9A. The distribution of the electron emission quantity arising from this voltage distribution is predicted to be as shown in FIG. 10B, and the correction rate required to correct for this is as illustrated in FIG. 10C. Such a correction rate is calculated beforehand with regard to all totaled values and is stored in the memory 207, thereby making possible a correction conforming to the image signal.

The multiplier 208, which is composed of logical elements or the like, multiplies the correction rate read out of the memory 207 by the luminance signals I'd1~I'dn outputted by the latch circuit 205 and outputs I"d1~I"dn to the modulating signal generator 209 as the corrected signals.

The image signals I"d1~I"dn which have thus been multiplied by the correction rate in the multiplier 208 are outputted to the modulating signal generator 209. The latter performs modulation in order to drive each of the cold cathode elements appropriately in dependence upon the signals I"d1~I"dn. The outputs of the modulating signal generator are applied to the cold cathode elements within the display panel 201 through the terminals Dy1~Dyn. It should be noted that the cold cathode elements relating to this embodiment have the basic characteristics, shown below, with regard to the emission current Ie. Specifically, as evident from the graph of Ie of FIG. 24, the electron emission has a definite threshold value Vth (8 V with the element of this embodiment), and an electron emission occurs only when a voltage greater than Vth has been applied.

Figure 24:
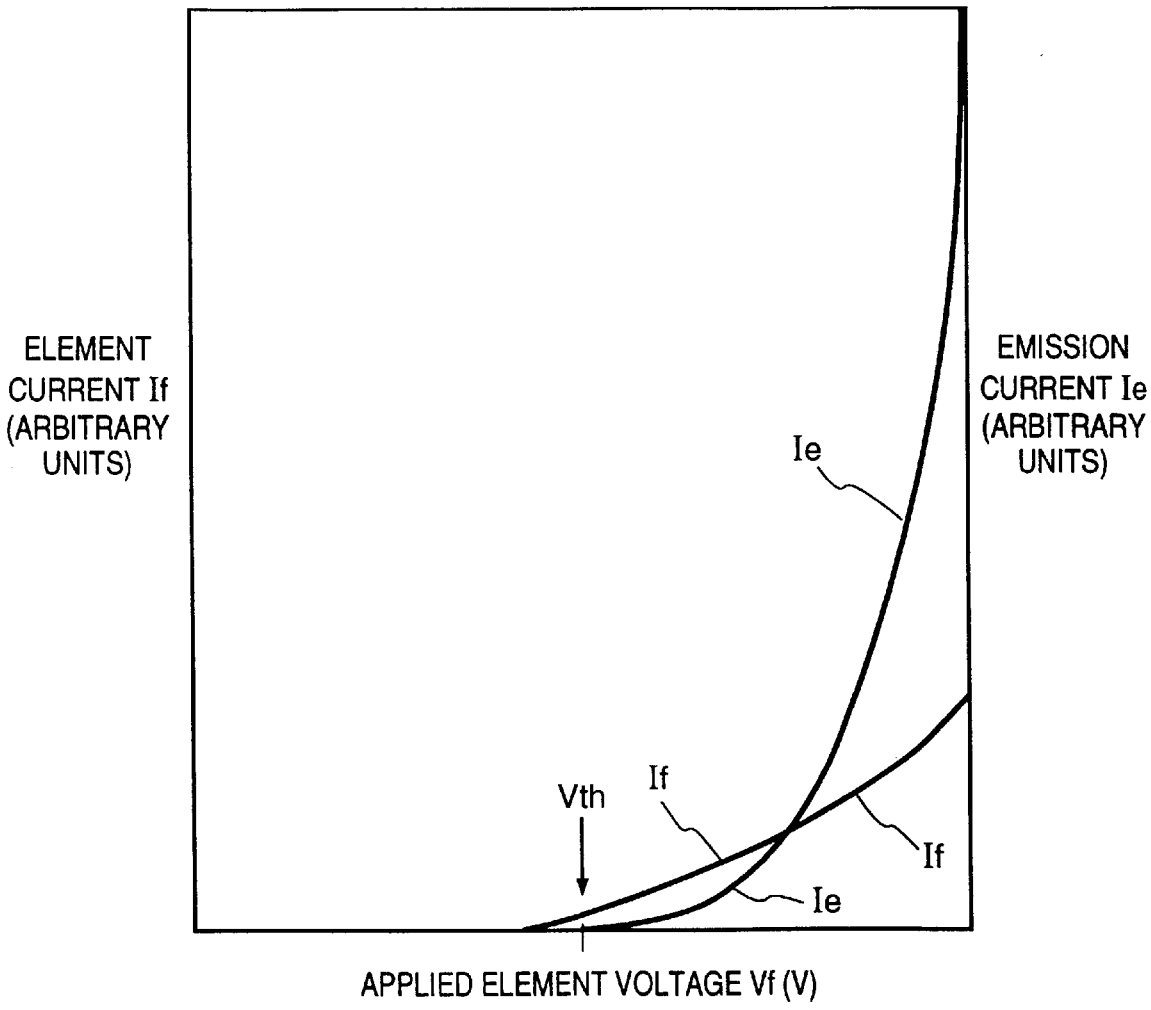
FIG. 24 is a graph showing typical characteristics of the surface-conduction electron emission element used in an embodiment.

Further, the emission current also changes in conformity with a change in voltage, as shown in FIG. 24, with regard to the voltage above the electron-emission threshold value Vth. By changing the material and constitution of the electron emission elements or the method of manufacture, the value of the electron-emission threshold voltage Vth and the degree of change in the emission current with respect to the applied voltage can be changed.

Figure 11A:
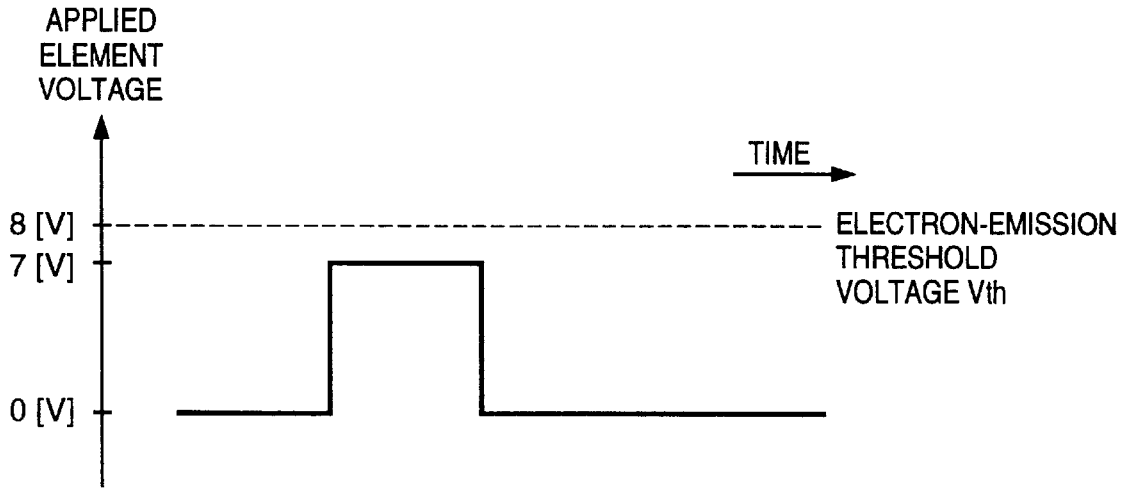
FIGS. 11A, 11B are graphs for describing the voltage waveform of a modulating signal.
Figure 11B:
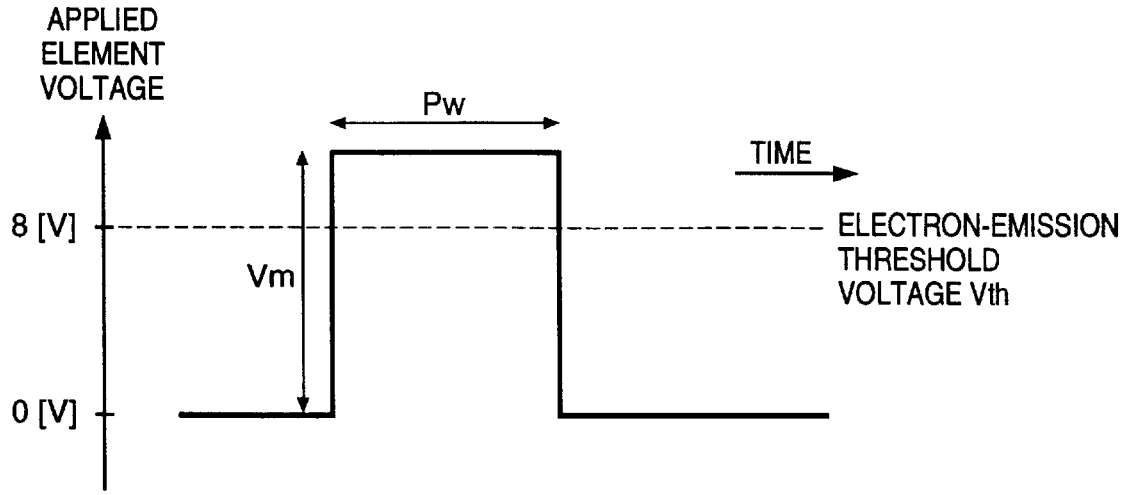

FIGS. 11A, 11B are diagrams showing examples of electron-emission control signals of the cold cathode elements. FIG. 11A is for a case in which a pulsed voltage less than the electron-emission threshold voltage (8 V) is applied to the element. No emission is produced in this case. However, an electron beam is outputted in a case where the pulsed voltage above the electron-emission threshold value (8 V) is applied, as shown in FIG. 11B. It is possible to control the intensity of the output electron beam by varying the peak value Vm of the pulse. In this case, the modulating signal generator 209 employed would be a circuit of a voltage modulating type which generates voltage pulses having a fixed width but which modulates the peak value of the pulses in conformity with the input data.

It is possible to control the total amount of electric charge of the outputted electron beam by varying the width Pw of the pulse. In this case, the modulating signal generator 209 employed would be a circuit of a pulse-width modulating type which generates voltage pulses of a fixed peak value but which modulates the width of the voltage pulses in conformity with the input data.

In this embodiment, the sum total of luminance of one line is adopted as a statistic on the original image in order to obtain correction data. However, this does not impose a limitation upon the invention. For example, it is permissible to use an average value obtained by dividing this sum total by the number of cold cathode elements in one row.

Further, in this embodiment, a digital video signal, which readily lends itself to data processing, is used as the input video signal. However, this does not impose a limitation upon the invention, for an analog video signal may be used.

Further, in this embodiment, the shift register 204, which is convenient in terms of processing a digital signal, is employed in the serial/parallel conversion processing. However, this does not impose a limitation upon the invention. For example, by controlling the storage addresses in such a manner that these addresses are changed in successive fashion, use may be made of an random-access memory having a function equivalent to that of the shift register.

Further, in this embodiment, a multiplier is employed as means for making the correction value operate upon the original video signal. However, this does not impose a limitation upon the invention. For example, in a case where the correction signal is calculated not as a rate but as a correction quantity, it will suffice to employ a digital adder. In other words, the circuitry should be determined in dependence upon the method of calculating the correction value.

Figure 12A:
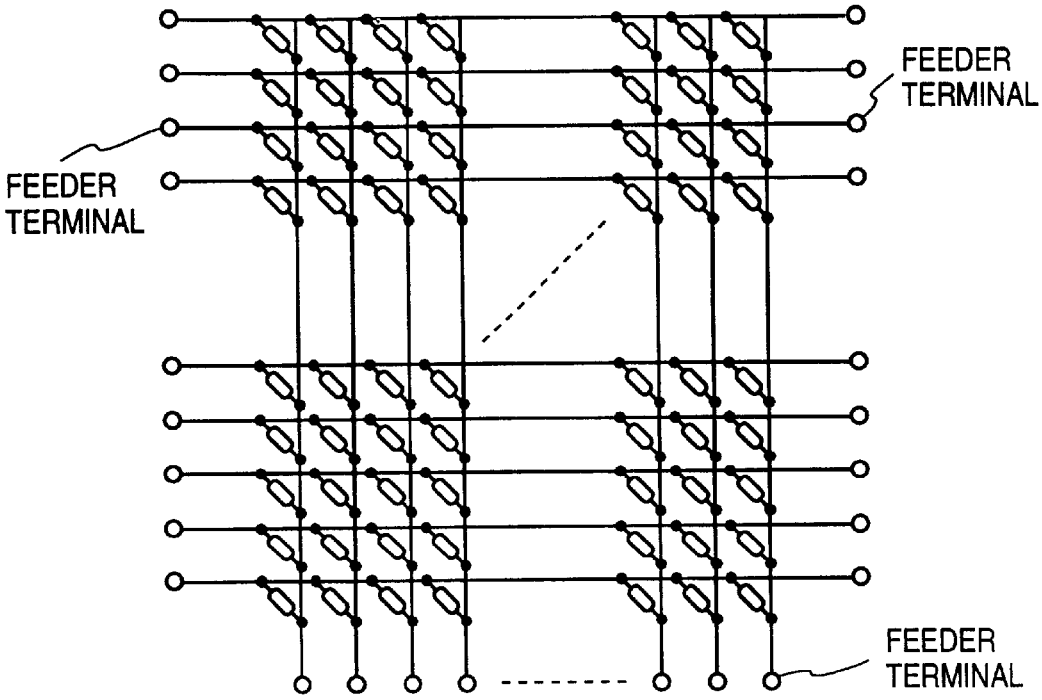
FIGS. 12A, 12B are diagrams showing the arrangement of feed terminals of another electron-beam generating device embodying the present invention.
Figure 12B:
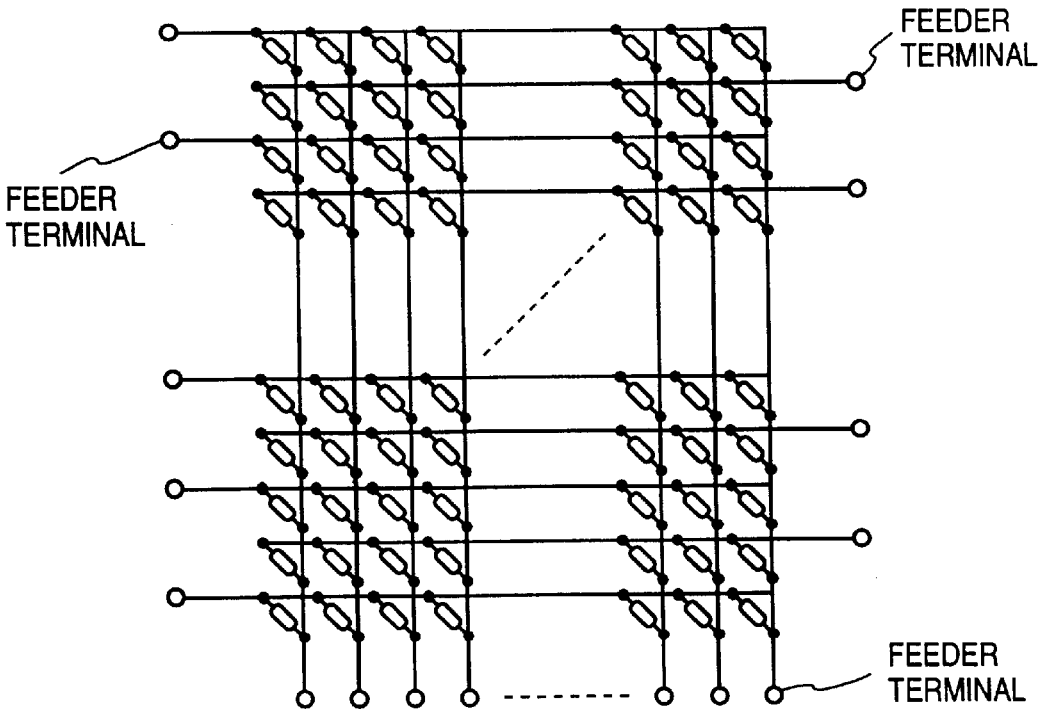

In the display panel of this embodiment, the feed terminals are arranged on two sides of the panel. However, this does not impose a limitation upon the invention because it is possible to calculate the correction value and effect compensation in a similar manner also in other terminal placement methods, as illustrated in FIGS. 12A, 12B, in which the terminals are placed on three sides (FIG. 12A) or in alternating fashion (FIG. 12B).

Figure 1:
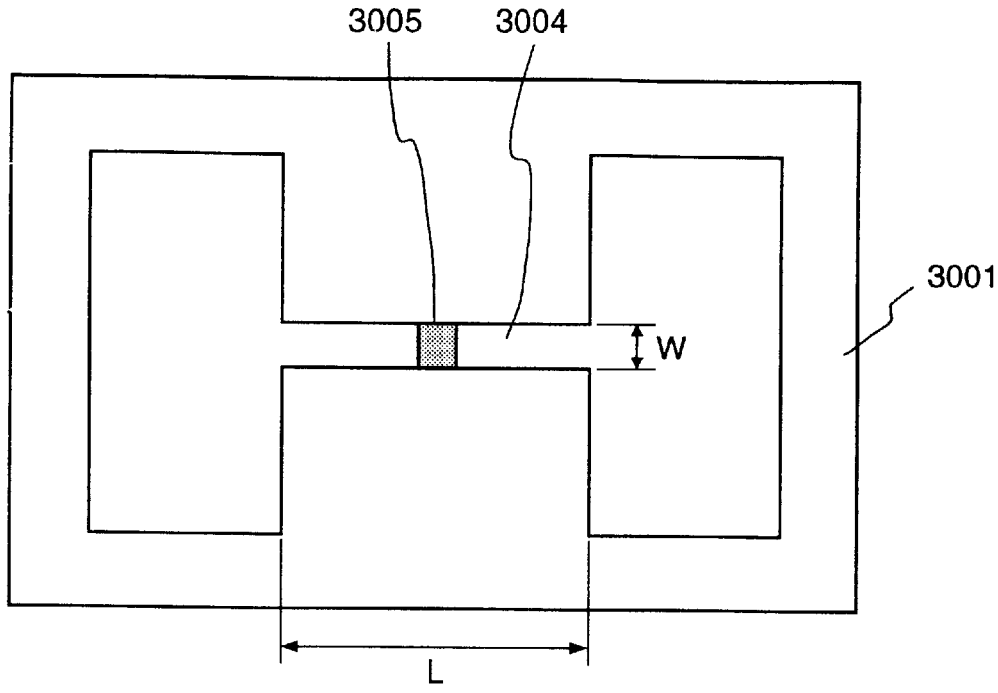
FIG. 1 is a plan view illustrating a surface-conduction electron emission element according to the prior art.
Figure 2:
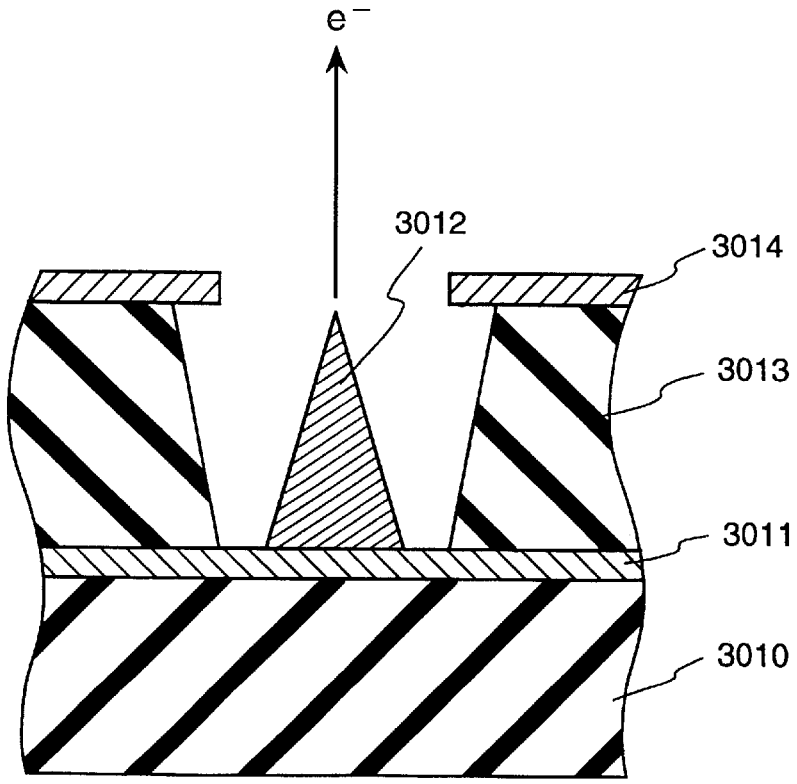
FIG. 2 is a sectional illustrating an FE-type electron emission element according to the prior art.
Figure 3:
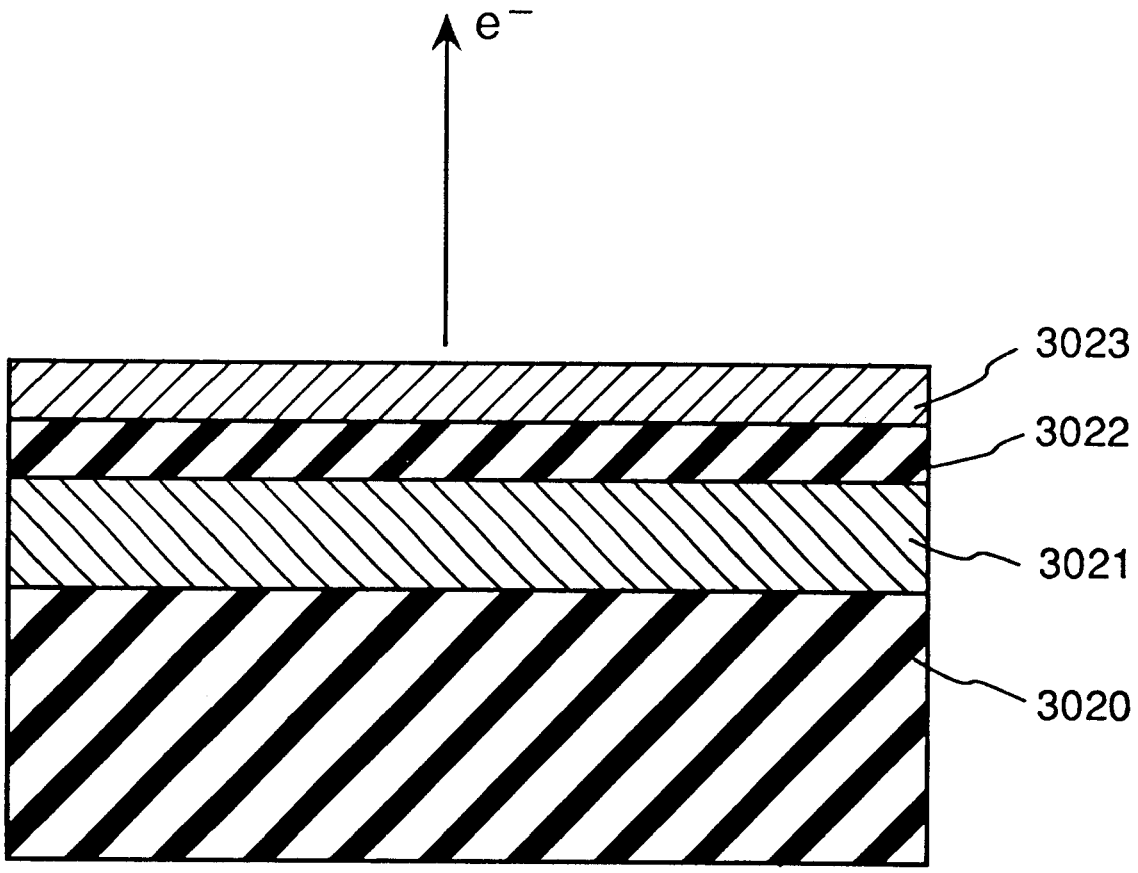
FIG. 3 is a sectional view illustrating a MIM-type electron emission element according to the prior art.
Figure 4:
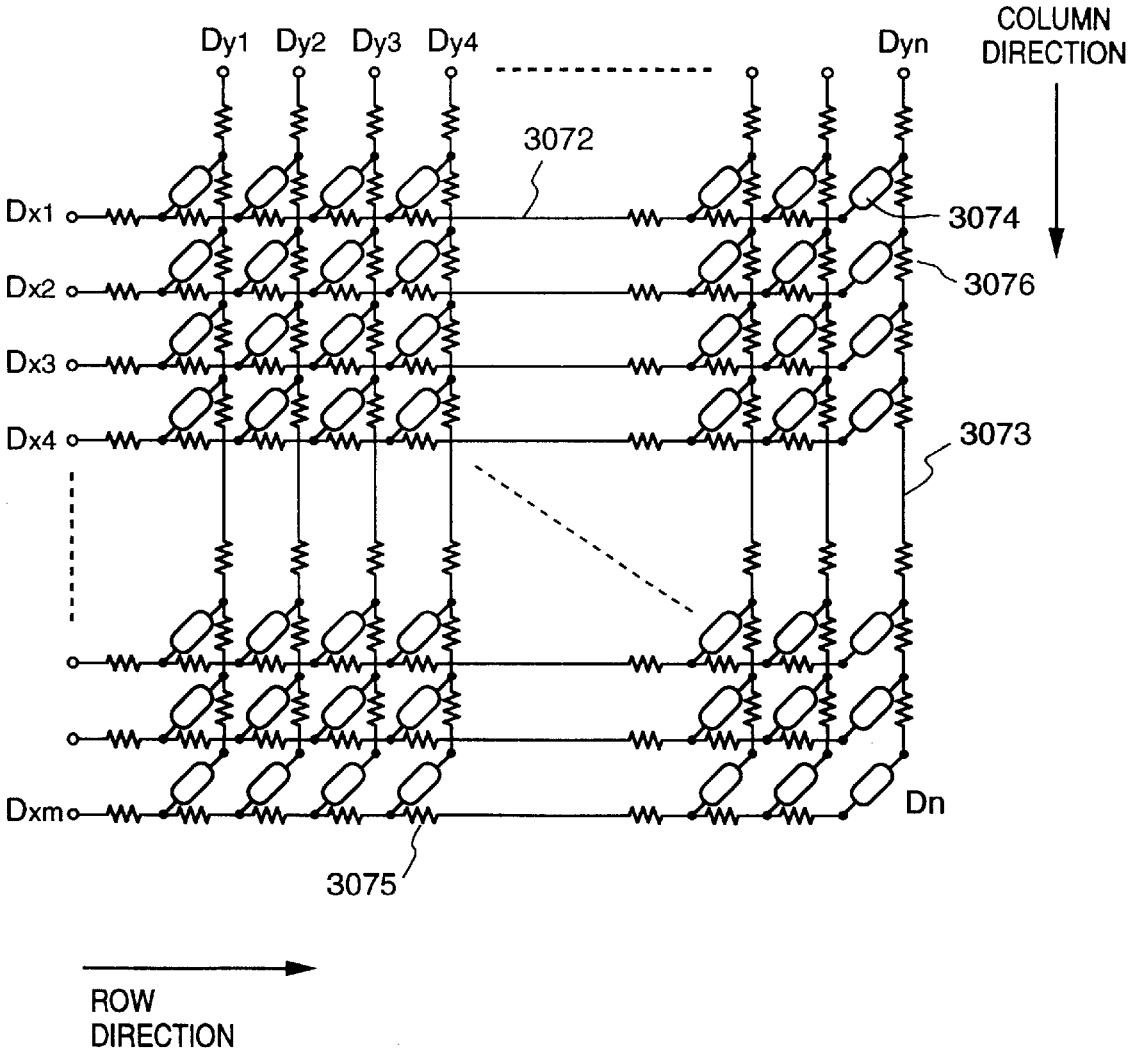
FIG. 4 is a diagram showing a method of matrix-wiring m×n electron emission elements.
Figure 5A:
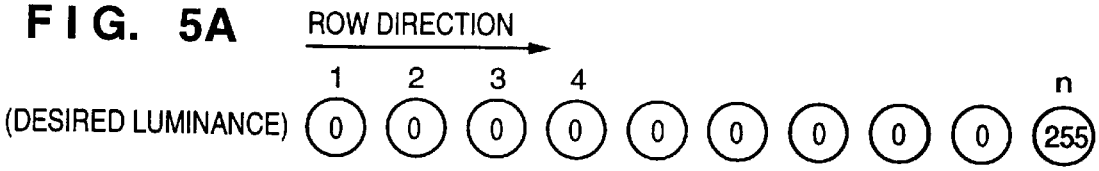
FIG. 5A is a diagram showing an example of luminance desired of one row (n-number) of pixels.
Figure 5B:
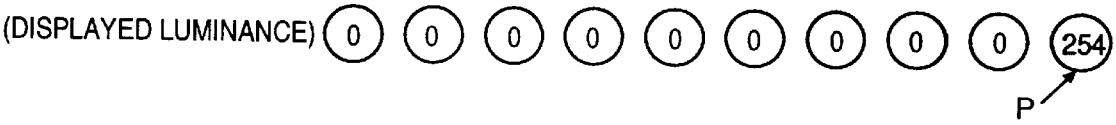
FIG. 5B is a diagram showing a deviation in luminance which occurs in the prior art when the pattern of FIG. 5A is displayed.
Figure 6A:
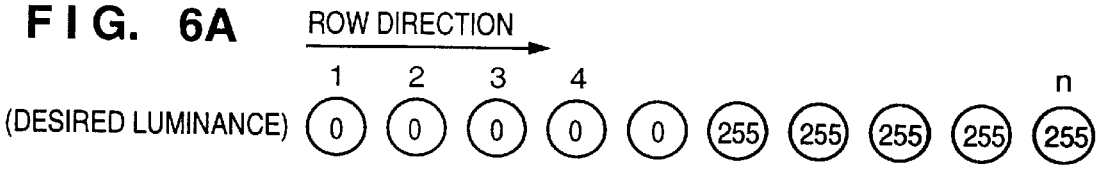
FIG. 6A is a diagram showing another example of luminance desired of one row (n-number) of pixels.
Figure 6B:
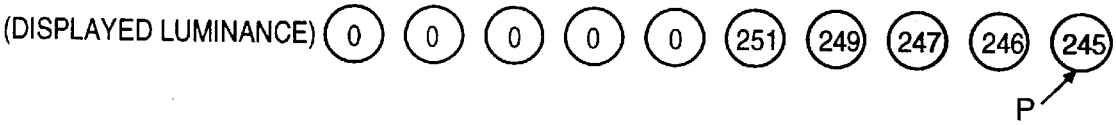
FIG. 6B is a diagram showing a deviation in luminance which occurs in the prior art when the pattern of FIG. 6A is displayed.
Figure 7A:
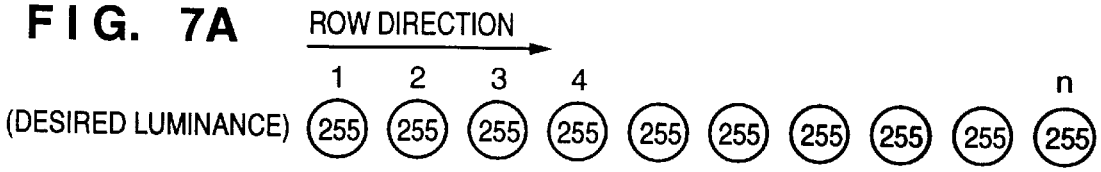
FIG. 7A is a diagram showing another example of luminance desired of one row (n-number) of pixels.
Figure 7B:
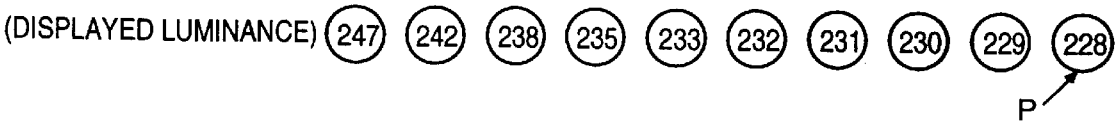
FIG. 7B is a diagram showing a deviation in luminance which occurs in the prior art when the pattern of FIG. 7A is displayed.
Figure 13A:
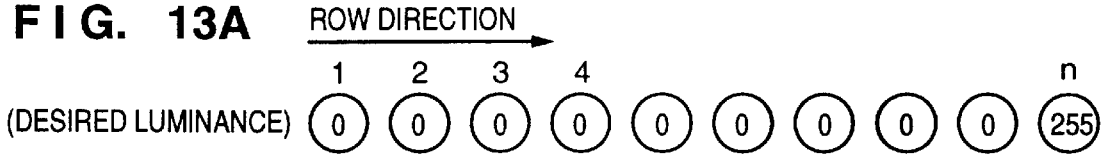
FIG. 13A is a diagram showing an example of luminance desired of one row (n-number) of pixels.
Figure 13B:
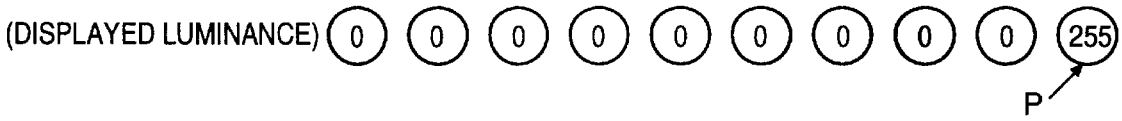
FIG. 13B is a diagram showing luminance when the pattern of FIG. 13A is displayed by the device of the first embodiment.
Figure 14A:
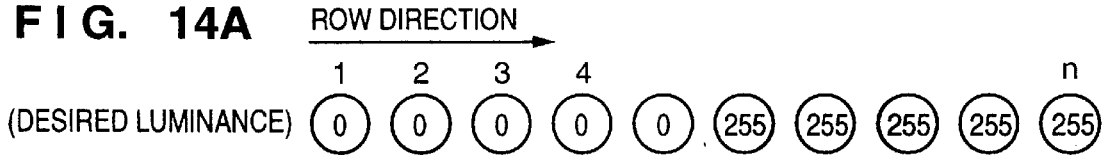
FIG. 14A is a diagram showing an example of luminance desired of one row (n-number) of pixels.
Figure 14B:
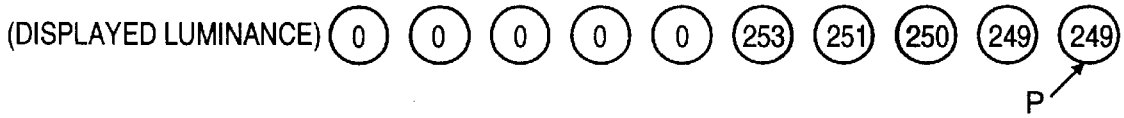
FIG. 14B is a diagram showing luminance when the pattern of FIG. 14A is displayed by the device of the first embodiment.
Figure 15A:
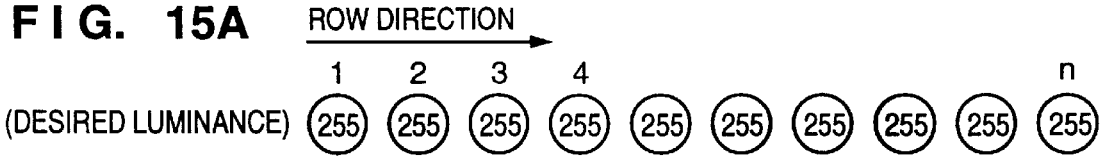
FIG. 15A is a diagram showing an example of luminance desired of one row (n-number) of pixels.
Figure 15B:
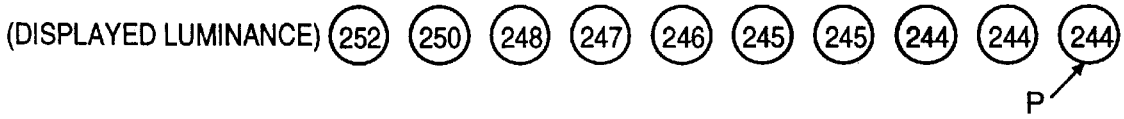
FIG. 15B is a diagram showing luminance when the pattern of FIG. 15A is displayed by the device of the first embodiment.

In accordance with this embodiment, effects are obtained in which the deviation between desired luminance and luminance actually displayed is greatly reduced in comparison with the conventional case described in connection with FIGS. 5A~7B. FIGS. 13A, 13B, FIGS. 14A, 14B and FIGS. 15A, 15B are diagrams for illustrating this fact. In order to facilitate the comparison, the luminance actually displayed is shown in FIGS. 13B, 14B, 15B with regard to a case in which luminance identical with that shown in FIGS. 5A, 6A, 7A is desired. In making the evaluation, use was made of an electron beam source having a structure the same as that employed when the evaluation shown in FIGS. 5B, 6B, 7B was made, and measurement was carried out upon selecting one row in the source.

These Figures clearly show that, with the present invention, it was possible to make the displayed luminance more precise in comparison with the prior art. Moreover, if attention is directed toward the pixels indicated by the arrows P, it will be apparent that even if the desired display pattern is changed, a fluctuation in luminance caused by the change can be reduced.

(Construction of Display Panel and Method of Manufacturing Same)

The construction and method of manufacturing the display panel 201 of the image display apparatus according to the first embodiment will now be described while giving an illustration of a specific example.

Figure 16:
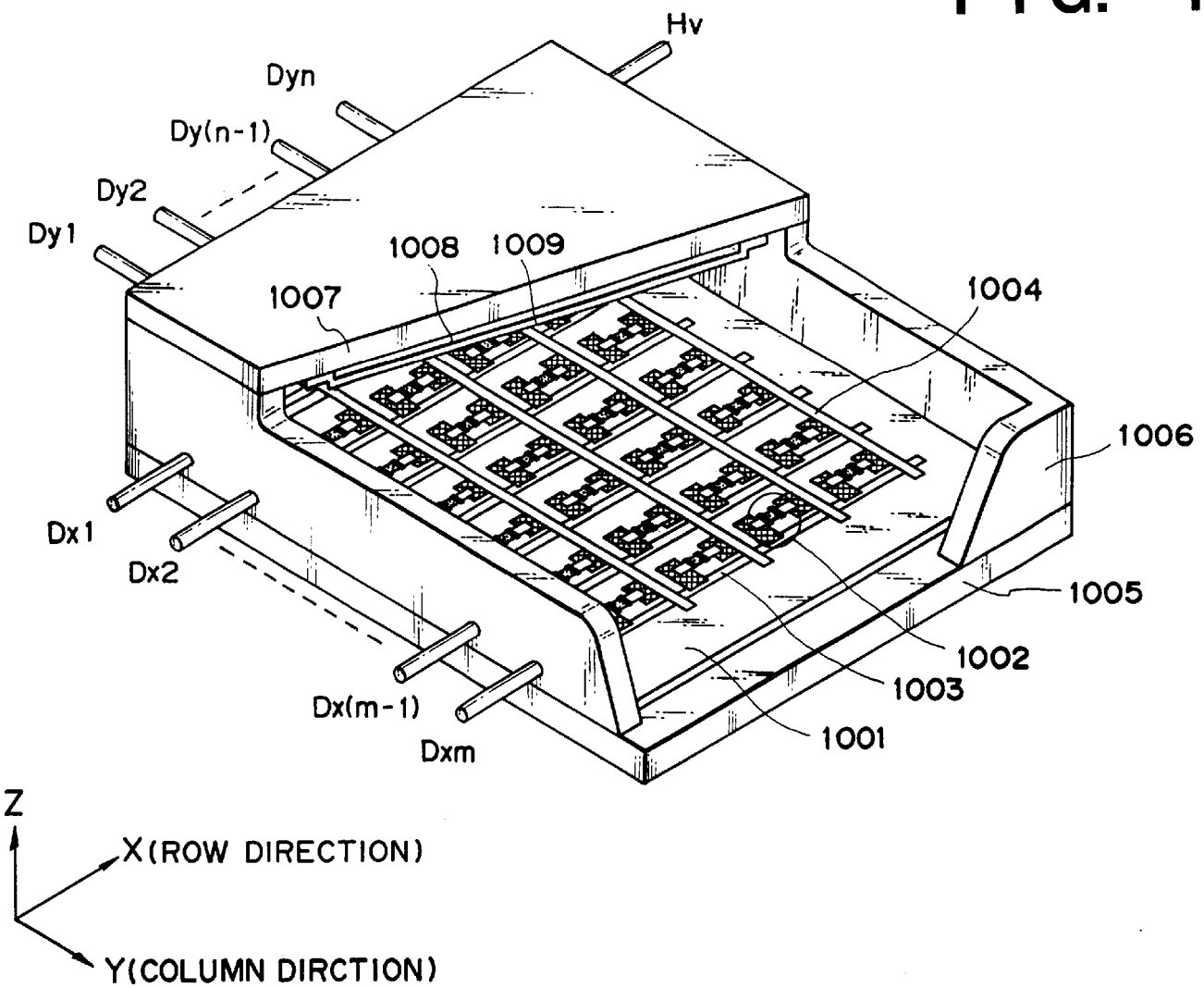
FIG. 16 is a perspective view, partially cut away, showing a display panel in an image display apparatus according to an embodiment of the present invention.

FIG. 16 is a perspective view of the display panel used in this embodiment. A portion of the panel is cut away in order to illustrate the internal structure.

Shown in FIG. 16 are a rear plate 1005, a side wall 1006 and a face plate 1007. A hermetic vessel for maintaining a vacuum in the interior of the display panel is formed by the components 1005~1007. In terms of assembling the hermetic vessel, the joints between the members require to be sealed to maintain sufficient strength and air-tightness. By way of example, a seal is achieved by coating the joints with frit glass and carrying out calcination in the atmosphere or in a nitrogen environment at a temperature of 400~500° C. for 10 min or more. The method of evacuating the interior of the hermetic vessel will be described later.

A substrate 1001 is fixed to the rear plate 1005, which substrate has m×n cold cathode elements formed thereon. (Here m, n are positive integers of having a value of two or greater, with the number being set appropriately in conformity with the number of display pixels intended. For example, in a display apparatus the purpose of which is to display high-definition television, it is desired that the set numbers of elements be no less than n=3000, m=1000. In this embodiment, n=3072, m=1024 hold.) The m×n cold cathode elements are matrix-wired by m-number of row-direction wires 1003 and n-number of column-direction wires 1004. The portion constituted by the components 1001~1004 is referred to as a "multiple electron beam source". The method of manufacturing the multiple electron beam source and the structure thereof will be described in detail later.

Figure 17A:
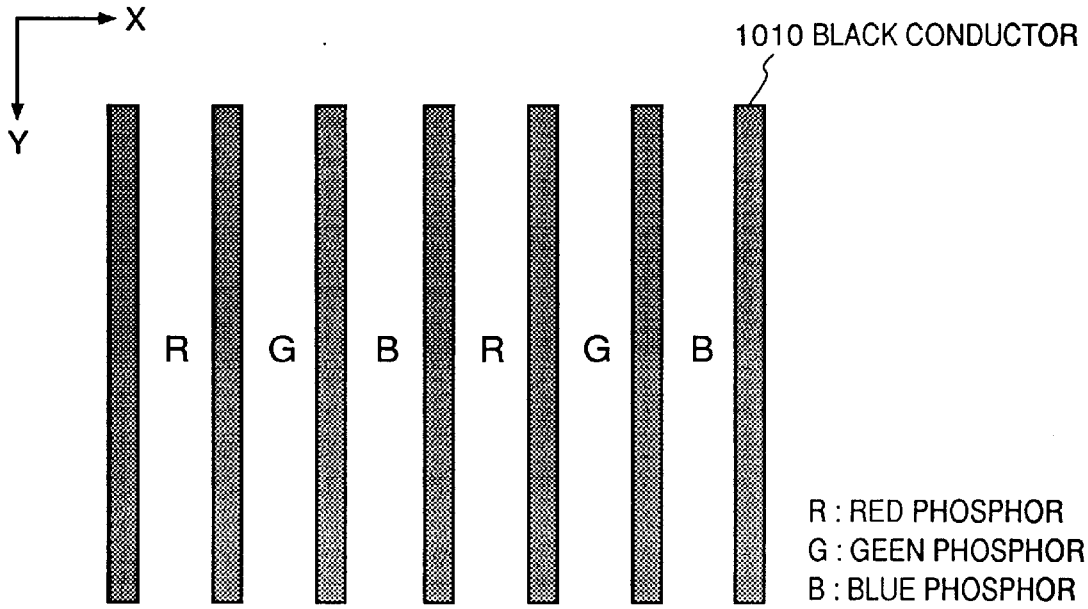
FIGS. 17A, 17B are plan views exemplifying phosphor arrays on a face plate of the display panel.

A phosphor film 1008 is formed on the underside of the face plate 1007. Since this embodiment relates to a color display apparatus, portions of the phosphor film 1008 are coated with phosphors of the three primary colors red, green and blue used in the field of CRT technology. The phosphor of each color is applied in the form of stripes, as shown in FIG. 17A, and a black conductor 1010 is provided between the phosphor stripes. The purpose of providing the black conductors 1010 is to assure that there will not be a shift in the display colors even if there is some deviation in the position irradiated with the electron beam, to prevent a decline in display contrast by preventing the reflection of external light, and to prevent the phosphor film from being charged up by the electron beam. Though the main ingredient used in the black conductor 1010 is graphite, any other material may be used so long as it is suited to the above-mentioned objectives.

Figure 17B:
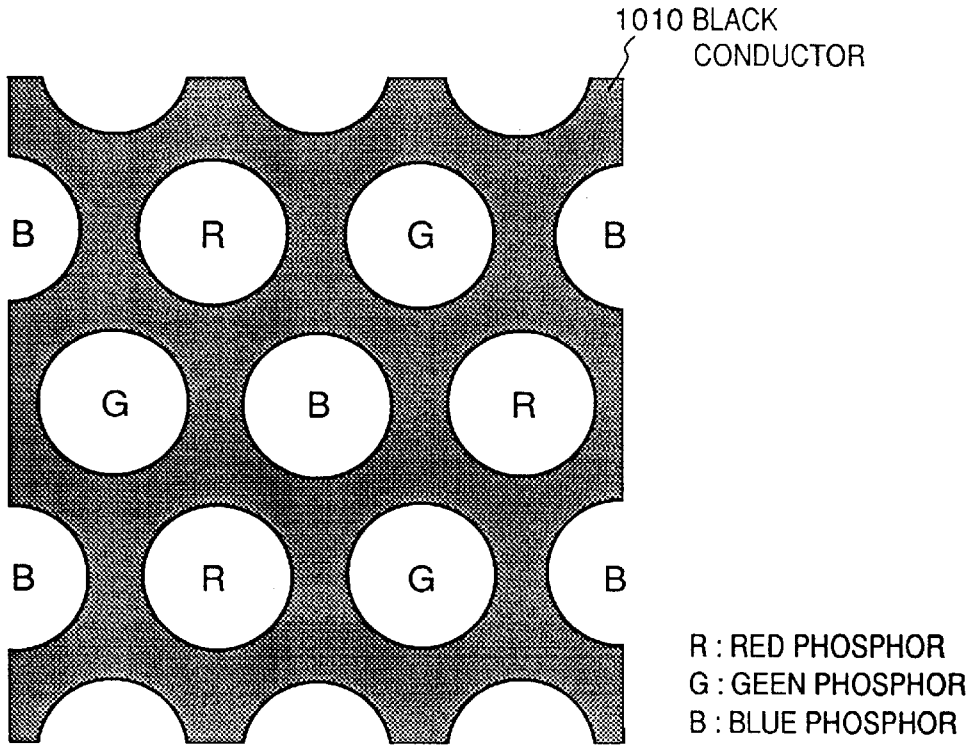

The application of the phosphors of the three primary colors is not limited to the stripe-shaped array shown in FIG. 17A. For example, a delta-shaped array, such as that shown in FIG. 17B, or other array may be adopted.

In a case where a monochromatic display panel is fabricated, a monochromatic phosphor material may be used as the phosphor film 1008 and the black conductor material need not necessarily be used.

Further, a metal backing 1009 well known in the field of CRT technology is provided on the surface of the phosphor film 1008. The purpose of providing the metal backing 1009 is to improve the utilization of light by reflecting part of the light emitted by the phosphor film 1008, to protect the phosphor film 1008 against damage due to bombardment by negative ions, to act as an electrode for applying an electron-beam acceleration voltage, and to act as a conduction path for the electrons that have excited the phosphor film 1008. The metal backing 1009 is fabricated by a method which includes forming the phosphor film 1008 on the face plate substrate 1007, subsequently smoothing the surface of the phosphor film and vacuum-depositing aluminum on this surface. In a case where a phosphor material for low voltages is used as the phosphor film 1008, the metal backing 1009 is unnecessary.

Though not used in this embodiment, transparent electrodes made of a material such as ITO may be provided between the face plate substrate 1007 and the phosphor film 1008.

Dx1~Dxm, Dy1~Dyn and Hv represent feed terminals, which have an air-tight structure, for connecting this display panel with electrical circuitry. The feed terminals Dx1~Dxm are electrically connected to the row-direction wires 1003 of the multiple electron beam source, the feed terminals Dy1~Dyn are electrically connected to the column-direction wires 1004 of the multiple electron beam source, and the terminal Hv is electrically connected to the metal backing 1009 of the face plate.

In order to evacuate the interior of the hermetic vessel, an exhaust pipe and a vacuum pump, not shown, are connected after the hermetic vessel is assembled and the interior of the vessel is exhausted to a vacuum of $10^{-7}$ Torr. The exhaust pipe is then sealed. In order to maintain the degree of vacuum within hermetic vessel, a getter film (not shown) is formed at a prescribed. position inside the hermetic vessel immediately before or immediately after the pipe is sealed. The getter film is a film formed by heating a getter material, the main ingredient of which is Ba, for example, by a heater or high-frequency heating to deposit the material. A vacuum on the order of $1\times10^{-5}$~$1\times10^{-7}$ Torr is maintained inside the hermetic vessel by the adsorbing action of the getter film.

The foregoing is a description of the basic construction and method of manufacture of the display panel according to this embodiment of the invention.

The method of manufacturing the multiple electron beam source used in the display panel of the foregoing embodiment will be described next. If the multiple electron beam source used in the image display apparatus of this invention is an electron source in which cold cathode elements are wired in the form of a matrix, there is no limitation upon the material, shape or method of manufacture of the cold cathode elements. Accordingly, it is possible to use cold cathode elements such as surface-conduction electron emission elements or cold cathode elements of the FE or MIM type.

Since there is demand for inexpensive display devices having a large display screen, the surface-conduction electron emission elements are particularly preferred as the cold cathode elements. More specifically, with the FE-type element, the relative positions of the emitter cone and gate electrode and the shape thereof greatly influence the electron emission characteristics. Consequently, a highly precise manufacturing technique is required. This is a disadvantage in terms of enlarging surface area and lowering the cost of manufacture. With the MIM-type element, it is required that the insulating layer and film thickness of the upper electrode be made uniform even if they are thin. This also is a disadvantage in terms of enlarging surface area and lowering the cost of manufacture. In this respect, the surface-conduction electron emission element is comparatively simple to manufacture, the surface area thereof is easy to enlarge and the cost of manufacture can be reduced with ease. Further, the inventors have discovered that, among the surface-conduction electron emission elements available, an element in which the electron emission portion or periphery thereof is formed from a film of fine particles excels in its electron emission characteristic, and that the element can be manufactured easily. Accordingly, it may be construed that such an element is most preferred for used in a multiple electron beam source in an image display apparatus having a high luminance and a large display screen. Accordingly, in the display panel of the foregoing embodiment, use was made of a surface-conduction electron emission element in which the electron emission portion or periphery thereof was formed from a film of fine particles. First, therefore, the basic construction, method of manufacture and characteristics of an ideal surface-conduction electron emission element will be described, and this will be followed by a description of the structure of a multiple electron beam source in which a large number of elements are wired in the form of a matrix.

(Element Construction Ideal for Surface-conduction Electron Emission Elements, and Method of Manufacturing Same)

A planar-type and step-type element are the two typical types of construction of surface-conduction electron emission elements available as surface-conduction electron emission elements in which the electron emission portion or periphery thereof is formed from a film of fine particles.

(Planar-type Surface-conduction Electron Emission Element)

Figure 18A:
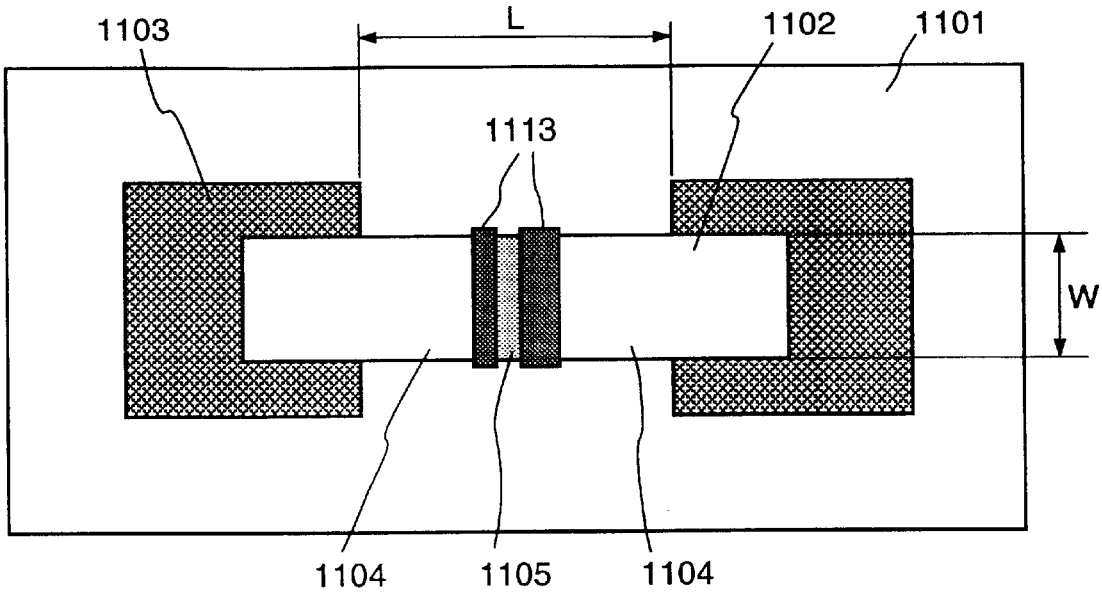
FIGS. 18A, 18B are a plan view and sectional view, respectively, of a planar-type surface-conduction electron emission element used in an embodiment.
Figure 18B:
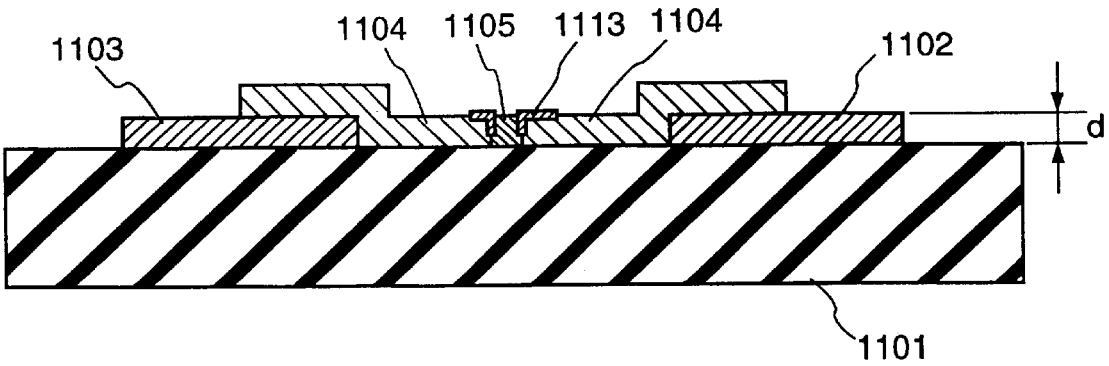

The element construction and manufacture of a planar-type surface-conduction electron emission element will be described first. FIGS. 18A, 18B are plan and sectional views, respectively, for describing the construction of a planar-type surface-conduction electron emission element.

Shown in FIGS. 18A, 18B are a substrate 1101, element electrodes 1102, 1103, an electrically conductive thin film 1104, an electron emission portion 1105 formed by an energization forming treatment, and a thin film 1113 formed by an electrification activation treatment.

Examples of the substrate 1101 are various glass substrates such as quartz glass and soda-lime glass, various substrates of a ceramic such as alumina, or a substrate obtained by depositing an insulating layer such as $SiO_2$ on the various substrates mentioned above.

The element electrodes 1102, 1103, which are provided to oppose each other on the substrate 1101 in parallel with the substrate surface, are formed from a material exhibiting electrical conductivity. Examples of the material that can be mentioned are the metals Ni, Cr, Au, Mo, W, Pt, Ti, Al, Cu, Pd and Ag or alloys of these metals, metal oxides such as $In_2O_3$—$SnO_2$ and semiconductor materials such as polysilicon. In order to form the electrodes, a film manufacturing technique such as vacuum deposition and a patterning technique such as photolithography or etching may be used in combination. However, it is permissible to form the electrodes using another method, such as a printing technique.

The shapes of the element electrodes 1102, 1103 are decided in conformity with the application and purpose of the electron emission element. In general, the spacing L1 between the electrodes may be a suitable value selected from a range of several hundred angstroms to several hundred micrometers. Preferably, the range is on the order of several micrometers to several tens of micrometers in order for the device to be used in a display apparatus. With regard to the thickness d of the element electrodes, a suitable numerical value is selected from a range of several hundred angstroms to several micrometers.

A film of fine particles is used at the portion of the electrically conductive thin film 1104. The film of fine particles mentioned here signifies a film (inclusive of island-shaped aggregates) containing a large number of fine particles as structural elements. If a film of fine particles is examined microscopically, usually the structure observed is one in which individual fine particles are arranged in spaced-apart relation, one in which the particles are adjacent to one another and one in which the particles overlap one another.

The particle diameter of the fine particles used in the film of fine particles falls within a range of from several angstroms to several thousand angstroms, with the particularly preferred range being 10 Å to 200 Å. The film thickness of the film of fine particles is suitably selected upon taking into consideration the following conditions: conditions necessary for achieving a good electrical connection between the element electrodes 1102 and 1103, conditions necessary for carrying out energization forming, described later, and conditions necessary for obtaining a suitable value, described later, for the electrical resistance of the film of fine particles per se. More specifically, the film thickness is selected in the range of from several angstroms to several thousand angstroms, preferably 10 Å to 500 Å.

Examples of the material used to form the film of fine particles are the metals Pd, Pt, Ru, Ag, Au, Ti, In, Cu, Cr, Fe, Zn, Sn, Ta, W and Pb, etc., the oxides PdO, $SnO_2$, $In_2O_3$, PbO and $Sb_2O_3$, etc., the borides $HfB_2$, $ZrM_2$, $LaB_6$, $CeB_6$, $YB_4$ and $GdB_4$, the carbides TiC, ZrC, HfC, TaC, SiC and WC, etc., the nitrides TiN, ZrN and HfN, etc., the semiconductors Si, Ge, etc., and carbon. The material may be selected appropriately from these.

As mentioned above, the electrically conductive thin film 1104 is formed from a film of fine particles. The sheet resistance is set so as to fall within the range of from $10^3$ to $10^7$ Ω/sq.

Since it is preferred that the electrically conductive thin film 1104 comes into good electrical contact with the element electrodes 1102, 1103, the adopted structure is such that the film and the element electrodes partially overlap each other. As for the methods of achieving this overlap, one method is to build up the device from the bottom in the order of the substrate, element electrodes and electrically conductive film, as shown in the example of FIG. 18B. Depending upon the case, the device may be built up from the bottom in the order of the substrate, electrically conductive film and element electrodes.

The electron emission portion 1105 is a fissure-shaped portion formed in part of the electrically conductive thin film 1104 and, electrically speaking, has a resistance higher than that of the surrounding conductive thin film. The fissure is formed by subjecting the electrically conductive thin film 1104 to an energization forming treatment, described later. There are cases in which fine particles having a particle diameter of several angstroms to several hundred angstroms are placed inside the fissure. It should be noted that since it is difficult to illustrate, finely and accurately, the actual position and shape of the electron emission portion, only a schematic illustration is given in FIGS. 18A, 18B.

The thin film 1113 comprises carbon or a carbon compound and covers the electron emission portion 1105 and its vicinity. The thin film 1113 is formed by carrying out an electrification activation treatment, described later, after the energization forming treatment.

The thin film 1113 is one or a mixture of single-crystal graphite, polycrystalline graphite or amorphous carbon. The film thickness preferably is less than 500 Å and preferably less than 300 Å.

It should be noted that since it is difficult to precisely illustrate the actual position and shape of the thin film 1113, only a schematic illustration is given in FIGS. 18A, 18B. Further, in the plan view of FIG. 18A, the element is shown with part of the thin film 1113 removed.

The desired basic construction of the element has been described. The following element was used in this embodiment:

Soda-lime glass was used as the substrate 1101, and a thin film of Ni was used as the element electrodes 1102, 1103. The thickness d of the element electrodes was 1000 Å, and the electrode spacing L was 2 μm. Pd or PdO was used as the main ingredient of the film of fine particles, the thickness of the film of fine particles was about 100 Å, and the width W was 100 μm.

The method of manufacturing the preferred planar-type of the surface-conduction electron emission element will now be described.

FIGS. 19A~19E are sectional views for describing the process steps for manufacturing the surface-conduction electron emission element. Portions similar to those in FIG. 18 are designated by like reference numerals.

Figure 19A:
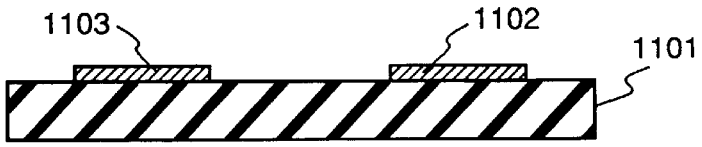
FIGS. 19A~19E are sectional views showing steps for manufacturing the planar-type surface-conduction electron emission element.

(1) First, the element electrodes 1102, 1103 are formed on the substrate 1101, as shown in FIG. 19A.

With regard to formation, the substrate 1101 is cleansed sufficiently in advance using a detergent, pure water or an organic solvent, after which the element electrode material is deposited. (An example of the deposition method used is a vacuum film forming technique such as vapor deposition or sputtering. Thereafter, the deposited electrode material is patterned using photolithography to form the pair of electrodes 1102, 1103 shown in FIG. 19A.

Figure 19B:
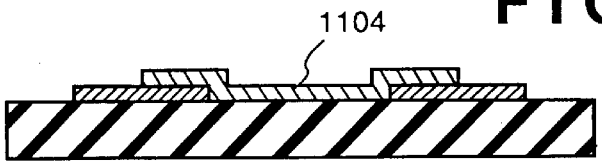

(2) Next, the electrically conductive thin film 1104 is formed, as shown in FIG. 19B. With regard to formation, the substrate of FIG. 19A is coated with an organic metal solution, the latter is allowed to dry, and heating and calcination treatments are applied to form a film of fine particles. Patterning is then carried out by photolithographic etching to obtain a prescribed shape. The organic metal solution is a solution of an organic metal compound in which the main element is the material of the fine particles used in the electrically conductive film. (Specifically, Pd was used as the main element in this embodiment. Further, the dipping method was employed as the method of application in this embodiment. However, other methods which may be used are the spinner method and spray method.)

Further, besides the method of applying the organic metal solution used in this embodiment as the method of forming the electrically conductive thin film made of the film of fine particles, there are cases in which use is made of vacuum deposition and sputtering or chemical vapor deposition.

Figure 19C:
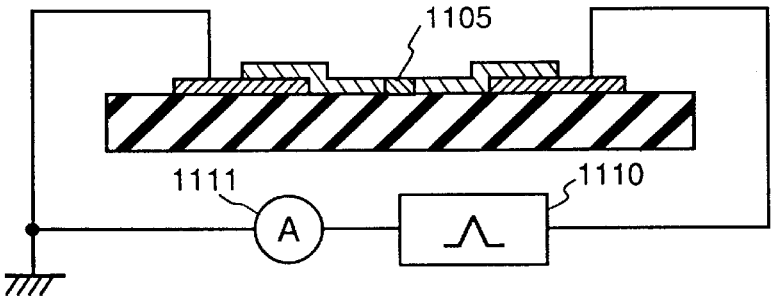

(3) Next, as shown in FIG. 19C, a suitable voltage is applied across the element electrodes 1102 and 1103 from a forming power supply 1110, whereby an energization forming treatment is carried out to form the electron emission portion 1105.

The energization forming treatment includes passing a current through the electrically conductive thin film 1104, which is made from the film of fine particles, to locally destroy, deform or change the property of this portion, thereby obtaining a structure ideal for performing electron emission. At the portion of the electrically conductive film, made of the film of fine particles, changed to a structure ideal for electron emission (i.e., the electron emission portion 1105), a fissure suitable for a thin film is formed. When a comparison is made with the situation prior to formation of the electron emission portion 1105, it is seen that the electrical resistance measured between the element electrodes 1102 and 1103 after formation has increased to a major degree.

Figure 20:
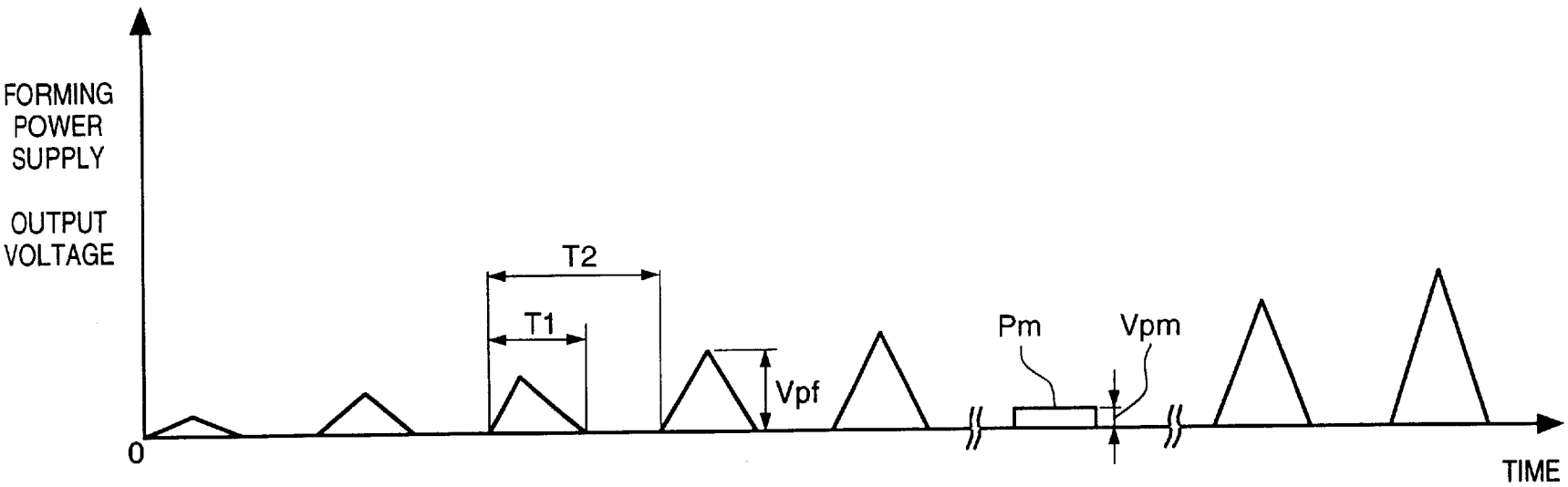
FIG. 20 is a diagram showing an applied voltage waveform at the time of an energization forming treatment.

In order to give a more detailed description of the electrification method, an example of a suitable voltage waveform supplied from the forming power supply 1110 is shown in FIG. 20. In a case where the electrically conductive film made of the film of fine particles is subjected to forming, a pulsed voltage is preferred. In the case of this embodiment, triangular pulses having a pulse width T1 were applied consecutive-ly at a pulse interval T2, as illustrated in the Figure. At this time, the peak value Vpf of the triangular pulses was gradually increased. A monitoring pulse Pm for monitoring the formation of the electron emission portion 1105 was inserted between the triangular pulses at a suitable spacing and the current which flows at such time was measured by an ammeter 1111.

In this embodiment, under a vacuum of, say, $10^{-5}$ Torr, the pulse width T1 and pulse interval T2 were made 1 msec a 10 msec, respectively, and the peak voltage Vpf was elevated at increments of 0.1 V every pulse. The monitoring pulse Pm was inserted at a rate of once per five of the triangular pulses. The voltage Vpm of the monitoring pulses was set to 0.1 V so that the forming treatment would not be adversely affected. Electrification applied for the forming treatment was terminated at the stage that the resistance between the terminal electrodes 1102, 1103 became $1\times10^{6}\Omega$, namely at the stage that the current measured by the ammeter 1111 at application of the monitoring pulse fell below $1\times10^{-7}$ A.

The method described above is preferred in relation to the surface-conduction electron emission element of this embodiment. In a case where the material or film thickness of the film consisting of the fine particles or the design of the surface-conduction electron emission element such as the element-electrode spacing L is changed, it is desired that the conditions of electrification be altered accordingly.

Figure 19D:
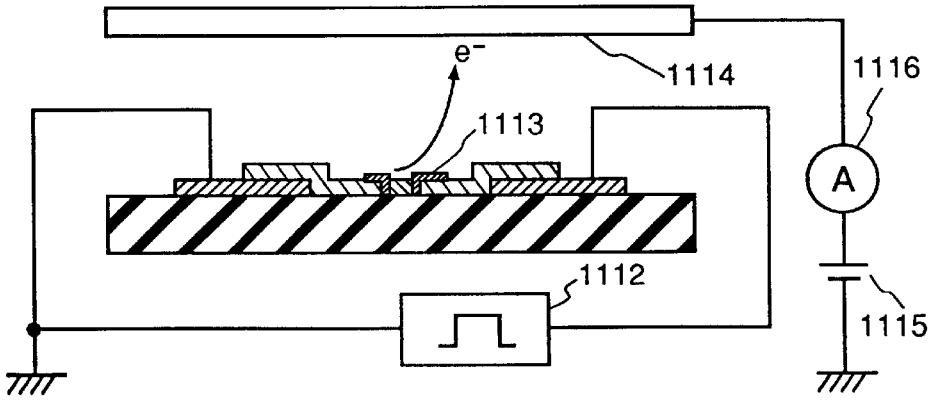

(4) Next, as shown in FIG. 19D, a suitable voltage from an activating power supply 1112 was impressed across the element electrodes 1102, 1103 to apply an electrification activation treatment, thereby improving the electron emission characteristic.

This electrification activation treatment involves subjecting the electron emission portion 1105, which has been formed by the above-described energization forming treatment, to electrification under suitable conditions and depositing carbon or a carbon compound in the vicinity of this portion. (In the Figure, the deposit consisting of carbon or carbon compound is illustrated schematically as a member 1113.) By carrying out this electrification activation treatment, the emission current typically can be increased by more than 100 times, at the same applied voltage, in comparison with the current before application of the treatment.

More specifically, by periodically applying voltage pulses in a vacuum ranging from $10^{-4}$ to $10^{-5}$ Torr, carbon or a carbon compound in which an organic compound present in the vacuum serves as the source is deposited. The deposit 1113 is one or a mixture of single-crystal graphite, polycrystalline graphite or amorphous carbon. The film thickness is less than 500 Å, preferably less than 300 Å.

Figure 21A:
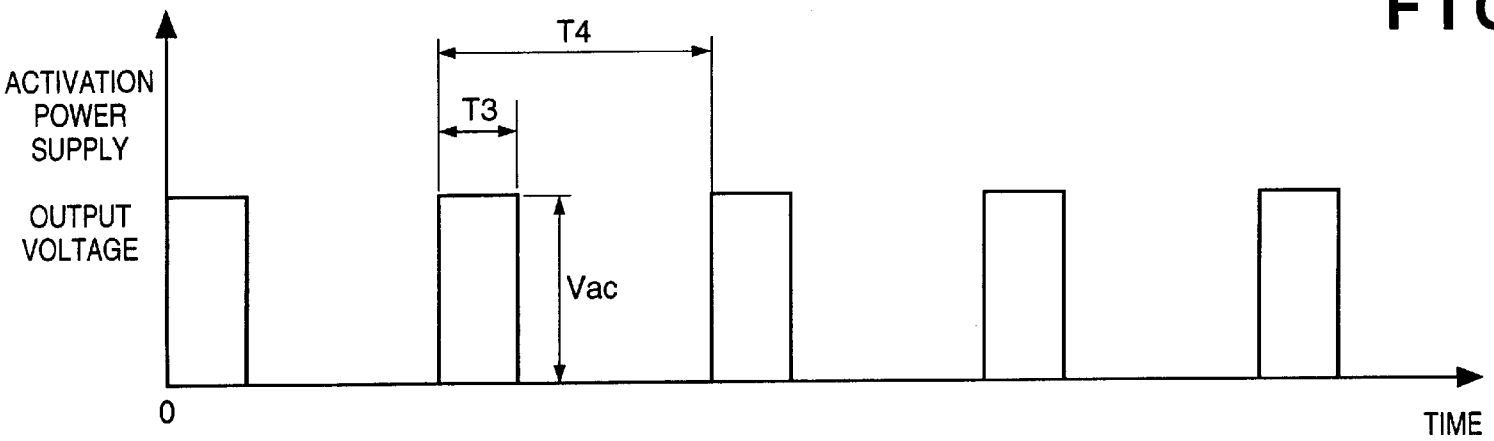
FIGS. 21A, 21B are diagrams showing an applied voltage waveform and a change in emission current Ie, respectively, at the time of an electrification activation treatment.

In order to give a more detailed description of the electrification method for activation, an example of a suitable waveform supplied by the activation power supply 1112 is illustrated in FIG. 21A. In this embodiment, the electrification activation treatment was conducted by periodically applying rectangular waves of a fixed voltage. More specifically, the voltage Vac of the rectangular waves was made 14 V, the pulse width T3 was made 1 msec, and the pulse interval T4 was made 10 msec. The electrification conditions for activation mentioned above are desirable conditions in relation to the surface-conduction electron emission element of this embodiment. In a case where the design of the surface-conduction electron emission element is changed, it is desired that the conditions be changed accordingly.

Numeral 1114 in FIG. 19D denotes an anode electrode for capturing the emission current Ie obtained from the surface-conduction electron emission element. The anode electrode is connected to a DC high-voltage power supply 1115 and to an ammeter 1116. (In a case where the activation treatment is carried out after the substrate 1101 is installed in the display panel, the phosphor surface of the display panel is used as the anode electrode 1114.)

Figure 21B:
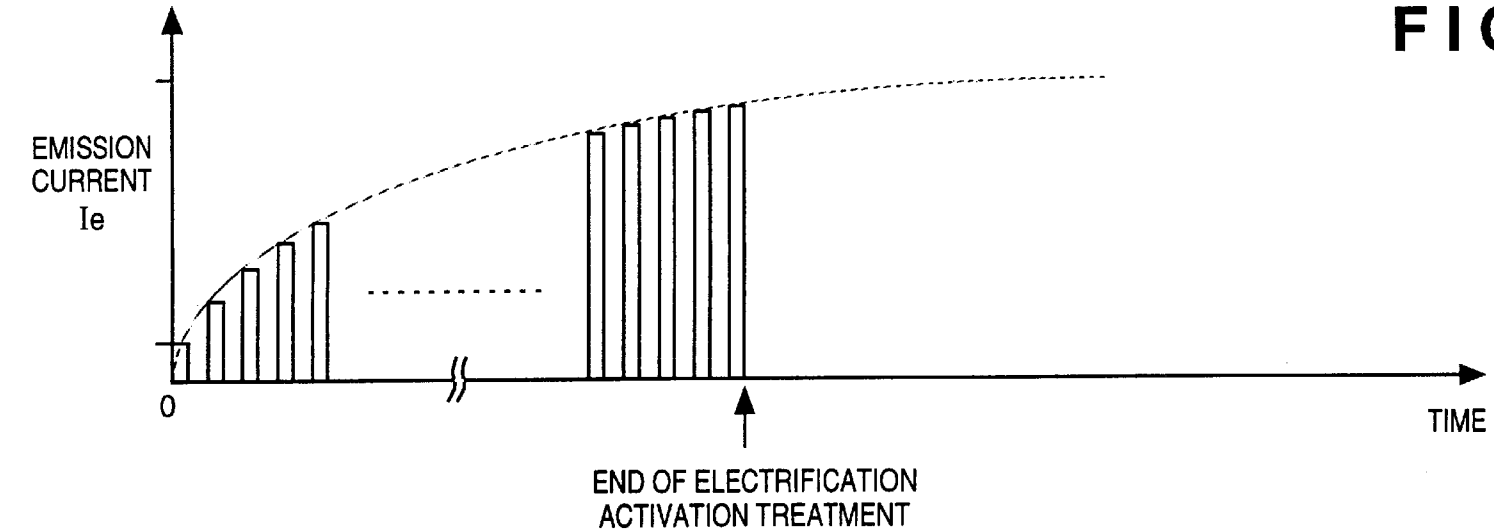

During the time that the voltage is being supplied from the activation power supply 1112, the emission current Ie is measured by the ammeter 1116 to monitor the progress of the electrification activation treatment, and the operation of the activation power supply 1112 is controlled. FIG. 21B illustrates an example of the emission current Ie measured by the ammeter 1116. When the pulsed voltage starts being supplied by the activation power supply 1112, the emission current le increases with the passage of time but eventually saturates and then almost stops increasing. At the moment the emission current Ie thus substantially saturates, the application of voltage from the activation power supply 1112 is halted and the activation treatment by electrification is terminated.

It should be noted that the above-mentioned electrification conditions are desirable conditions in relation to the surface-conduction electron emission element of this embodiment. In a case where the design of the surface-conduction electron emission element is changed, it is desired that the conditions be changed accordingly.

Figure 19E:
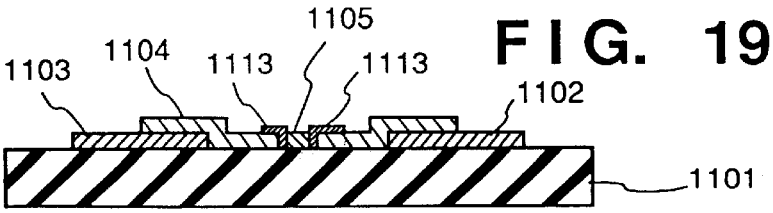

Thus, the planar-type surface-conduction electron emission element shown in FIG. 19E is manufactured as set forth above.

(Step-type Surface-conduction Electron Emission Element)

Next, one more typical construction of a surface-conduction electron emission element in which the electron emission portion or its periphery is formed from a film of fine particles, namely the construction of a step-type surface-conduction electron emission element, will be described.

Figure 22:
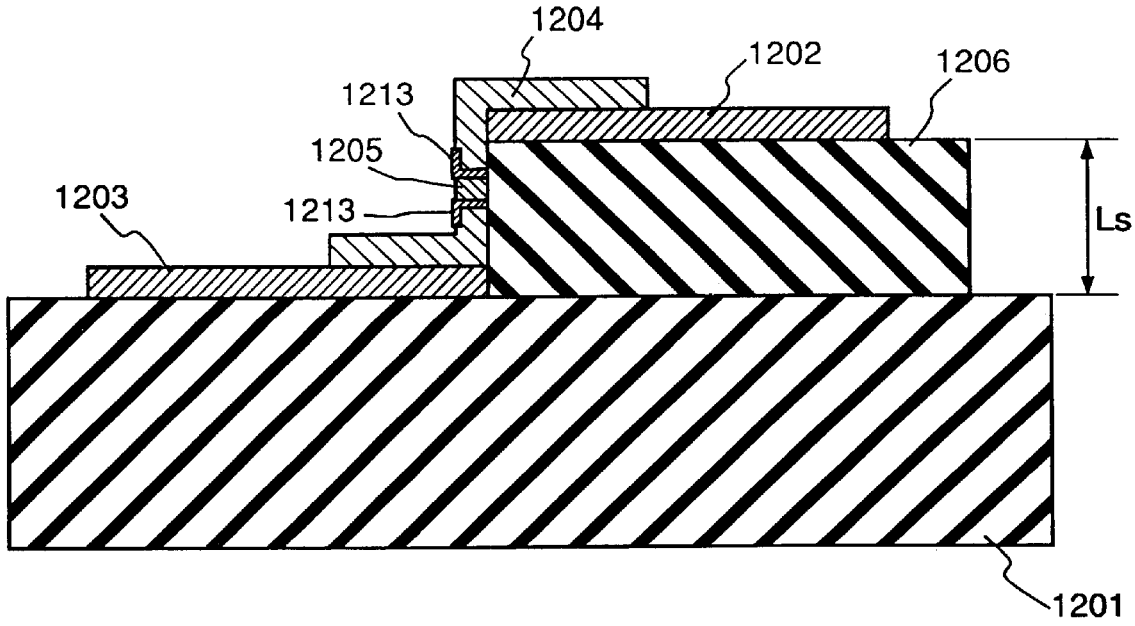
FIG. 22 is a sectional view of a step-type surface-conduction electron emission element used in an embodiment.

FIG. 22 is a schematic sectional view for describing the basic construction of the step-type element. Numeral 1201 denotes a substrate, 1202 and 1203 element electrodes, 1206 a step forming member, 1204 an electrically conductive thin film using a film of fine particles, 1205 an electron emission portion formed by an energization forming treatment, and 1213 a thin film formed by an electrification activation treatment.

The step-type element differs from the planar-type element in that one element electrode (1202) is provided on the step forming member 1206, and in that the electrically conductive thin film 1204 covers the side of the step forming member 1206. Accordingly, the element-electrode spacing L in the planar-type surface-conduction electron emission element shown in FIG. 18 is set as the height Ls of the step forming member 1206 in the step-type element. The substrate 1201, the element electrodes 1202, 1203 and the electrically conductive thin film 1204 using the film of fine particles can consist of the same materials mentioned in the description of the planar-type element. An electrically insulating material such as $SiO_2$ is used as the step forming member 1206.

A method of manufacturing the step-type surface-conduction electron emission element will now be described. FIGS. 23A~23F are sectional views for describing the manufacturing steps. The reference characters of the various members are the same as those in FIG. 22.

Figure 23A:
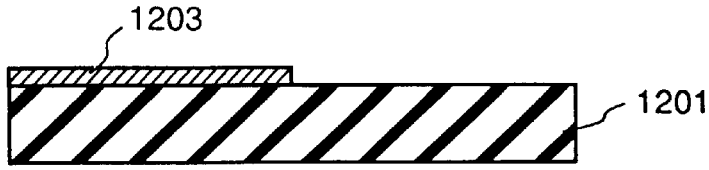
FIGS. 23A~23F are sectional views showing steps for manufacturing the step-type surface-conduction electron emission element.

(1) First, the element electrode 1203 is formed on the substrate 1201, as shown in FIG. 23A.

Figure 23B:
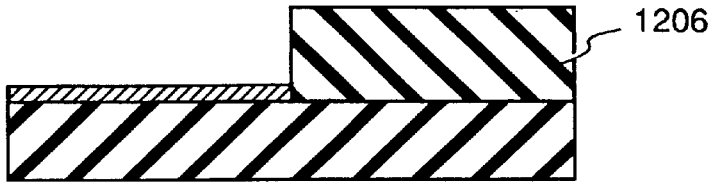

(2) Next, an insulating layer for forming the step forming member is built up, as shown in FIG. 23B. It will suffice if this insulating layer is formed by building up $SiO_2$ using the sputtering method. However, other film forming methods may be used, such as vacuum deposition or printing, by way of example.

Figure 23C:
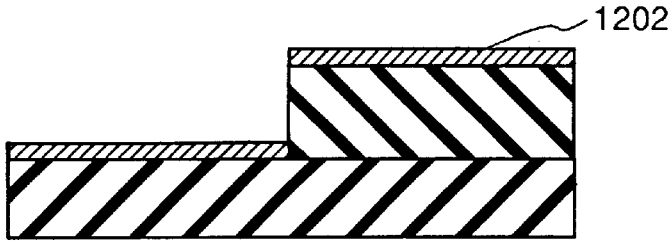

(3) Next, the element electrode 1202 is formed on the insulating layer, as shown in FIG. 23C.

Figure 23D:
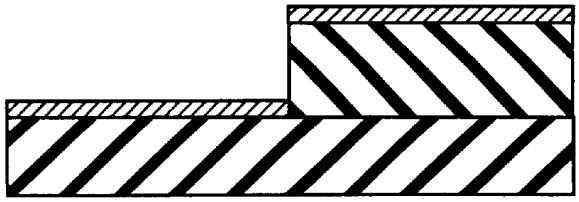

(4) Next, part of the insulating layer is removed by an etching process, thereby exposing the element electrode 1203, as shown in FIG. 23D.

Figure 23E:
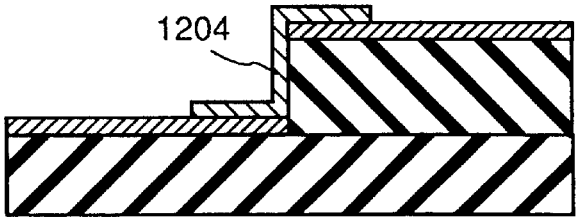

(5) Next, the electrically conductive thin film 1204 using the film of fine particles is formed, as shown in FIG. 23E. In order to form the electrically conductive thin film, it will suffice to use a film forming technique such as painting in the same manner as in the case of the planar-type element.

(6) Next, an energization forming treatment is carried out in the same manner as in the case of the planar-type element, thereby forming the electron emission portion. (It will suffice to carry out a treatment similar to the planar-type energization forming treatment described using FIG. 19C.)

(7) Next, as in the case of the planar-type element, the electrification activation treatment is performed to deposit carbon or a carbon compound on in the vicinity of the electron emission portion. (It will suffice to carry out a treatment similar to the planar-type electrification activation treatment described using FIG. 19D.)

Figure 23F:
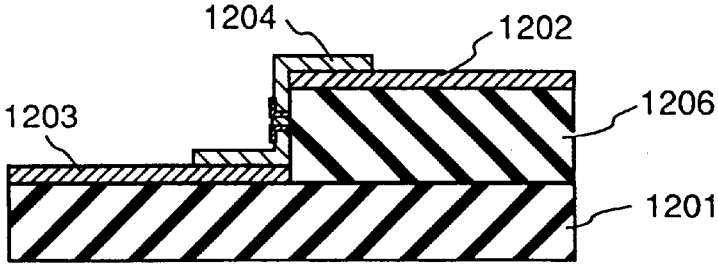

Thus, the step-type surface-conduction electron emission element shown in FIG. 23F is manufactured as set forth above.

(Characteristics of Surface-conduction Electron Emission Element Used in Display Apparatus)

The element construction and method of manufacturing the planar- and step-type surface-conduction electron emission elements have been described above. The characteristics of these elements used in a display apparatus will now be described.

FIG. 24 illustrates a typical example of an (emission current Ie) vs. (applied element voltage Vf) characteristic and of an (element current If) vs. (applied element voltage Vf) characteristic of the elements used in a display apparatus. It should be noted that the emission current Ie is so much smaller than the element current If that it is difficult to use the same scale to illustrate it. Moreover, these characteristics are changed by changing the design parameters such as the size and shape of the elements. Accordingly, the two curves in the graph are each illustrated using arbitrary units.

The elements used in this display apparatus have the following three features in relation to the emission current Ie:

First, when a voltage greater than a certain voltage (referred to as a threshold voltage Vth) is applied to the element, the emission current Ie suddenly increases. When the applied voltage is less than the threshold voltage vth, on the other hand, almost no emission current Ie is detected. In other words, the element is a non-linear element having the clearly defined threshold voltage Vth with respect to the emission current Ie.

Second, since the emission current Ie varies in dependence upon the voltage Vf applied to the element, the magnitude of the emission current Ie can be controlled by the voltage Vf.

Third, since the response speed of the current Ie emitted from the element is high in response to a change in the voltage Vf applied to the element, the amount of charge of the electron beam emitted from the element can be controlled by the length of time over which the voltage Vf is applied.

By virtue of the foregoing characteristics, surface-conduction electron emission elements are ideal for use in a display apparatus. For example, in a display apparatus in which a number of elements are provided to correspond to pixels of a displayed image, the display screen can be scanned sequentially to present a display if the first characteristic mentioned above is utilized. More specifically, a voltage greater than the threshold voltage Vth is suitably applied to driven elements in conformity with a desired light-emission luminance, and a voltage less than the threshold voltage Vth is applied to elements that are in an unselected state. By sequentially switching over elements driven, the display screen can be scanned sequentially to present a display.

Further, by utilizing the second characteristic or third characteristic, the luminance of the light emission can be controlled. This makes it possible to present a grayscale display.

(Structure of Multiple Electron Beam Source Having Number of Elements Wired in Form of Matrix)

Described next will be the structure of a multiple electron beam source obtained by arraying the aforesaid surface-conduction electron emission elements on a substrate and wiring the elements in the form of a matrix.

Figure 25:
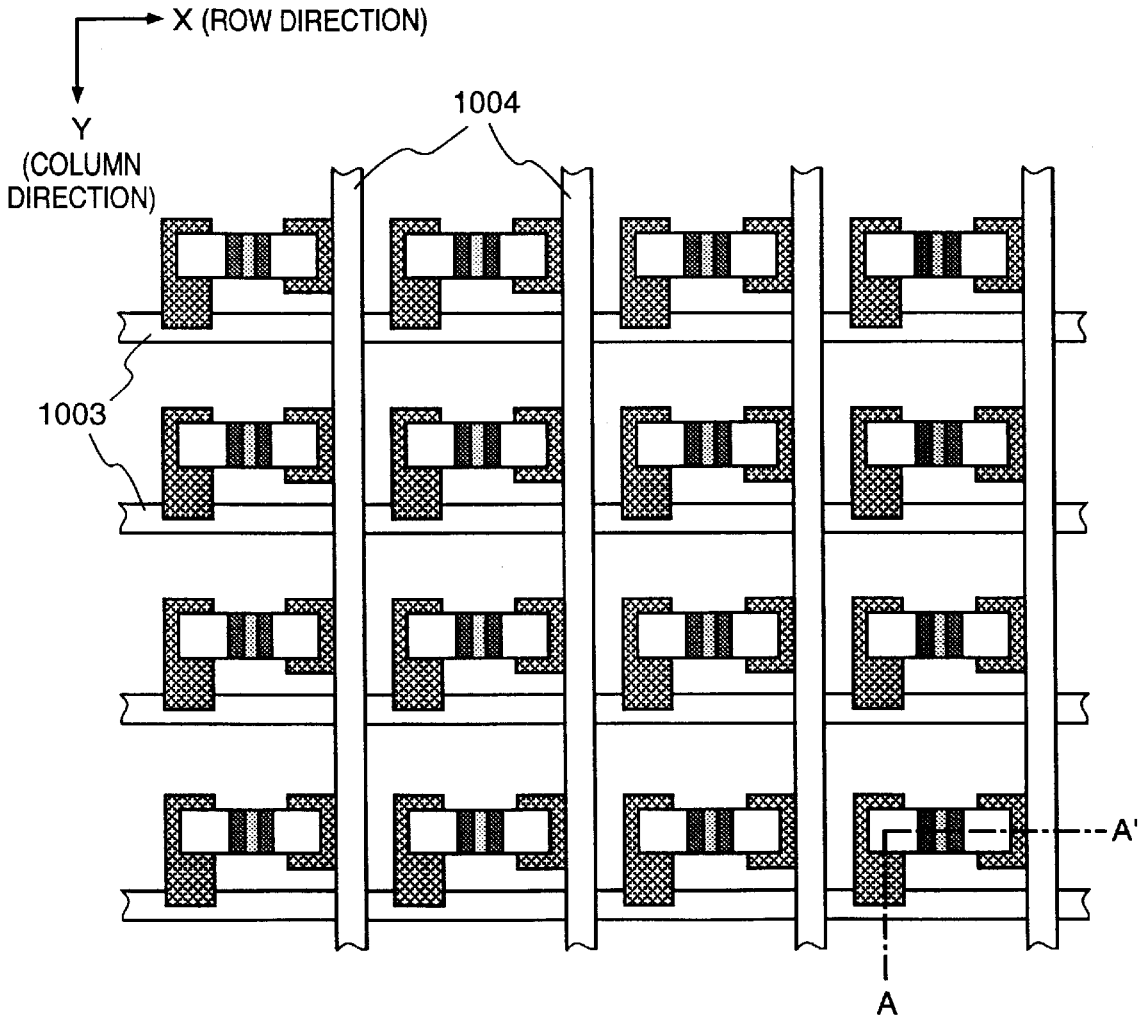
FIG. 25 is a plan view showing the substrate of a multiple electron beam source used in an embodiment.

FIG. 25 is a plan view of a multiple electron beam source used in the display panel of FIG. 16. Here surface-conduction electron emission elements similar to the type shown in FIG. 18 are arrayed on the substrate and these elements are wired in the form of a matrix by the row-direction wiring electrodes 1003 and column-direction wiring electrodes 1104. An insulating layer (not shown) is formed between the electrodes at the portions where the row-direction wiring electrodes 1003 and column-direction wiring electrodes 1004 intersect, thereby maintaining electrical insulation between the electrodes.

Figure 26:
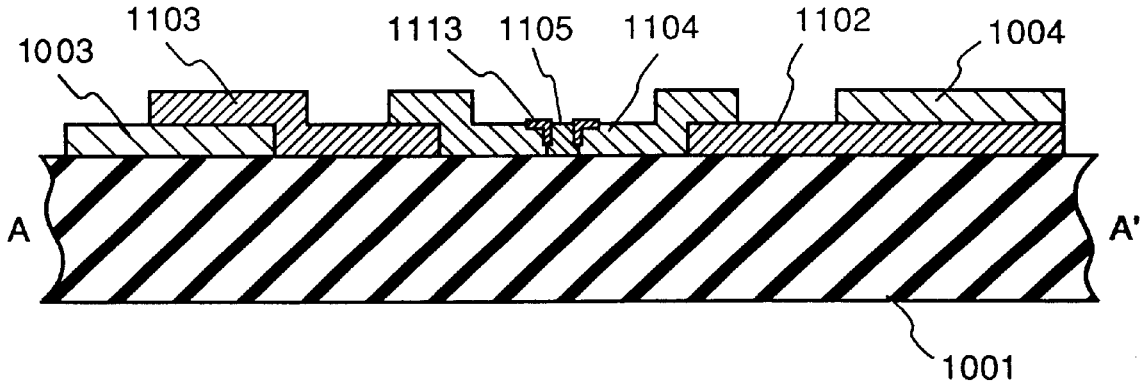
FIG. 26 is a partial plan view showing the substrate of a multiple electron beam source used in an embodiment.

FIG. 26 is a sectional view taken along line A–A' of FIG. 25.

It should be noted that the multiple electron source having this structure is manufactured by forming the row-direction wiring electrodes 1003, column-direction wiring electrodes 1004, inter-electrode insulating layer (not shown) and the element electrodes and electrically conductive thin film of the surface-conduction electron emission elements on the substrate in advance, and then applying the energization forming treatment and electrification activation treatment by supplying current to each element via the row-direction wiring electrodes 1003 and column-direction wiring electrodes 1004.

Second Embodiment

A second embodiment of the present invention will be described next.

In the first embodiment, a correction is applied to each line (Dx1 to Dxm) based upon equal correction rates. Strictly speaking, however, owing to the influence of resistance of the wiring in the column direction, the voltage distribution in a row near the column-direction feeder terminals differs from that in a row remote from the column-direction feeder terminals. In order to improve upon this, it is necessary to perform a correction which differs row by row. The second embodiment is proposed from this point of view.

The structures of the cold cathode elements and display panel in the second embodiment are similar to those of the second embodiment. The following description focuses upon the method of drive and the method of correcting the image display apparatus of the second embodiment. The description will be rendered with reference to FIG. 27.

Figure 27:
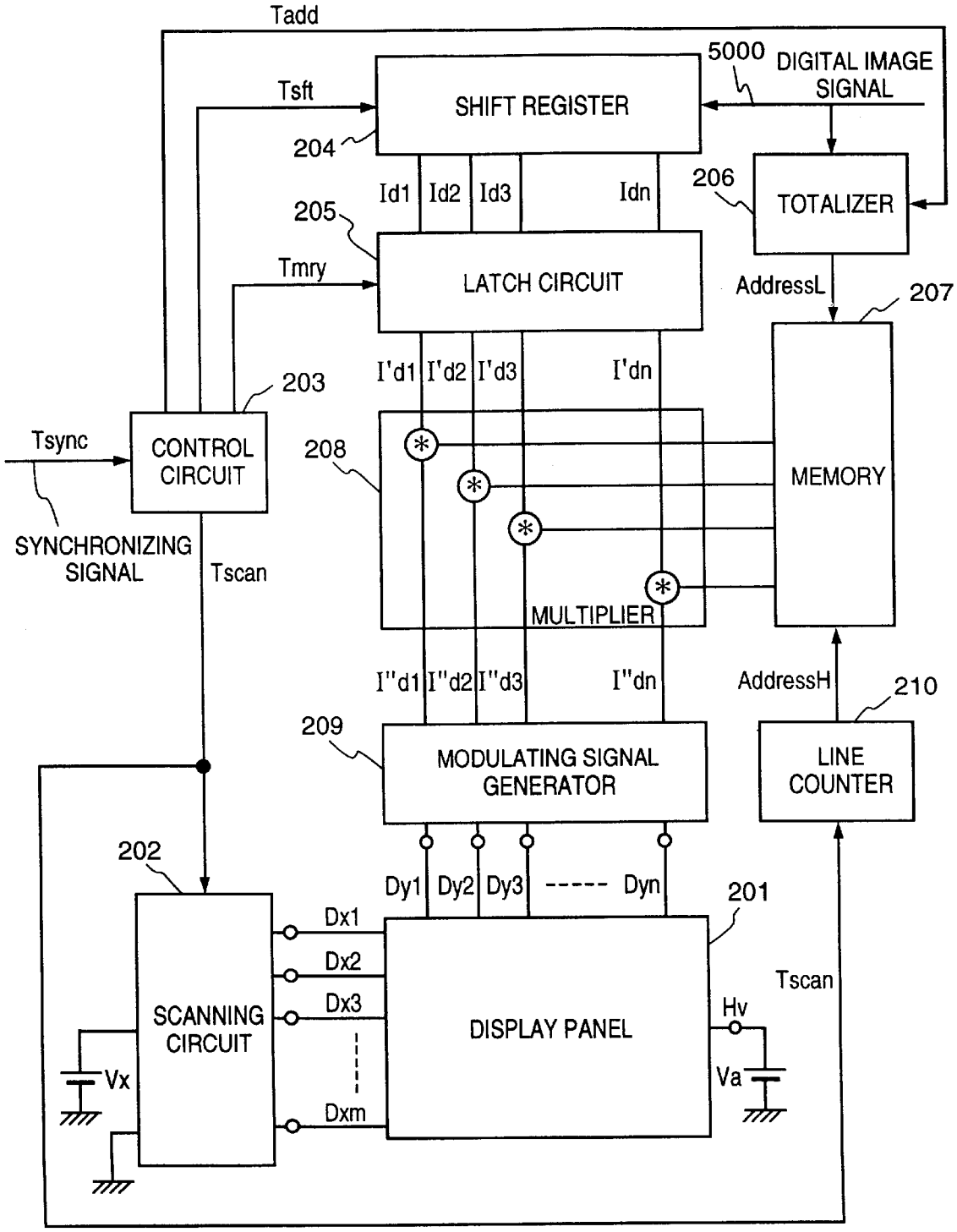
FIG. 27 is a circuit diagram showing the circuit arrangement of a second embodiment of the present invention.

Reference numeral 201 in FIG. 27 denotes the display panel, which is similar to that described in the first embodiment.

The scanning circuit 202, control circuit 203, shift register 204 and latch circuit 205 also are identical with those described in the first embodiment. Furthermore, the totalizer 206 is identical with that described in the first embodiment. A line counter 210 is added on to the first embodiment, counts the clock of the Tscan signal and counts which row is being selected by the scanning circuit 202.

The method of correction will now be described. As described in connection with the first embodiment, the totalizer 206 totals one row of luminance signals and outputs the total as the address of the memory 207. This address constitutes the lower order bits (e.g., eight bits) of the memory 207. The line counter 210 outputs the address of the memory 207. This address constitutes the higher order bits (e.g., ten bits if the row-direction wires of the display panel 201 are 1024 in number). The full address (composed of 18 bits, for example) of the memory 207 is decided by these higher and lower order bits. In other words, the row is selected by the higher order address and the correction value of total luminance of each row is selected by the lower order address.

Figure 28A:
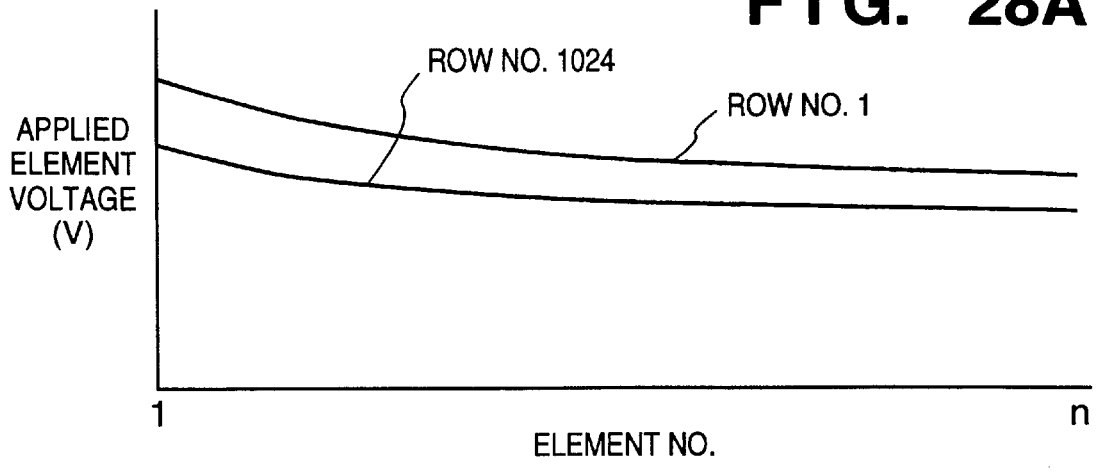
FIGS. 28A~28C are graphs for describing a process for calculating a correction rate.
Figure 28B:
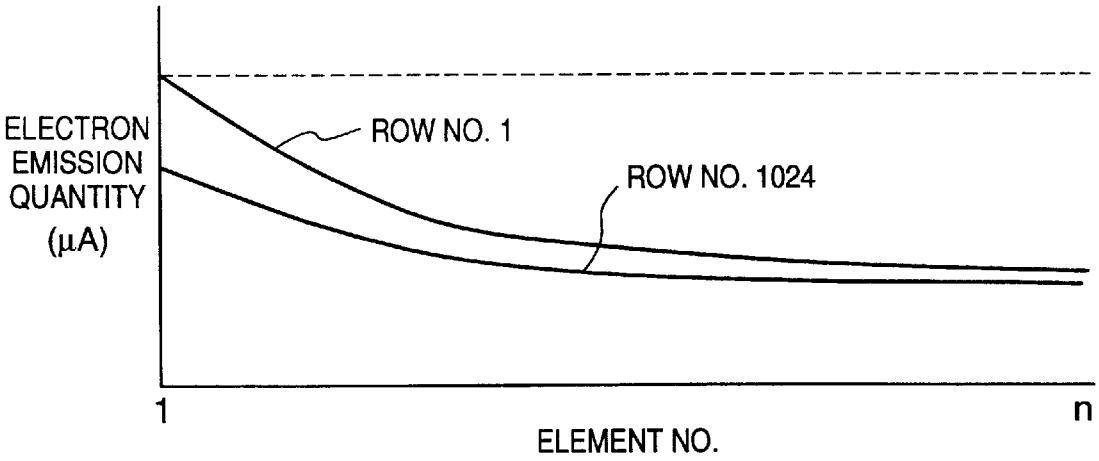
Figure 28C:
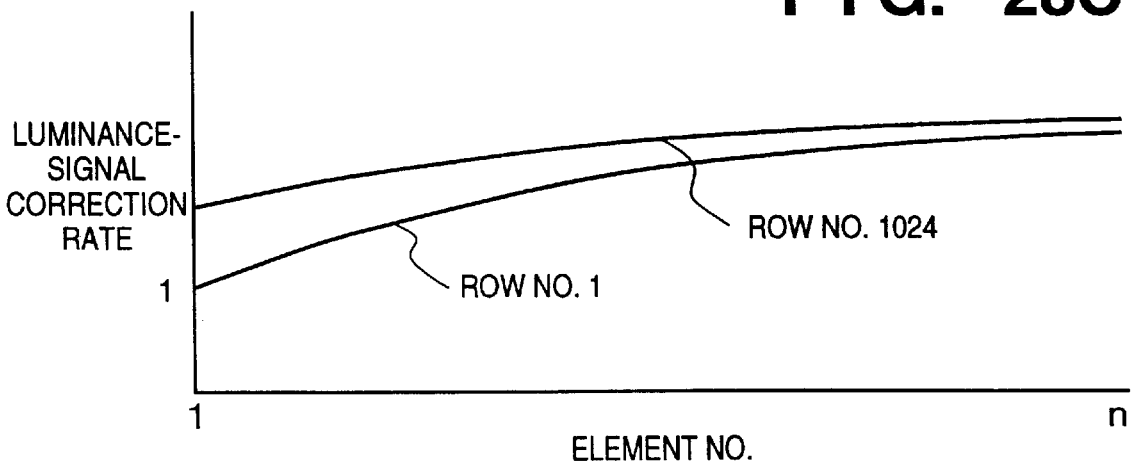

The correction rate stored in the memory 207 will be described with reference to FIGS. 28A~28C. The method of setting the correction rate with regard to one certain row basically is similar to that of the first embodiment. When the total value $I_{total}$ has been entered, how the correction rate will differ depending upon the row number (the number of the row wire) is as illustrated in FIG. 28C. With respect to row number 1 (on the side nearest the feeder terminal of the column-direction wire), the influence of the resistance of the column wiring is small and, hence, the voltage distribution is as defined by the curve of FIG. 28A. Accordingly, the electron emission quantity in a case where a correction is not applied is predicted to be as shown in FIG. 28B and therefore the correction rate for compensating for this is decided in the manner of FIG. 28C. On the other hand, since the influence of the column wiring resistance at row number 1024 is great, a different correction rate is decided. Thus, by computing the correction rate for each row with respect to the totaled value of all luminances and storing the correction ratios in the memory 207, it is possible to perform a correction of luminance row by row.

Thus, as described above, a high-quality image display apparatus having little luminance distribution is obtained by correcting the distribution of the amount of electron emission.

Further, in this embodiment, the correction rate is decided in units of one pixel. In this case, the optimum correction results are obtained.

Figures 29A, 29B, 29C, 30A, 30B, 30C, 31A, 31B, 31C:
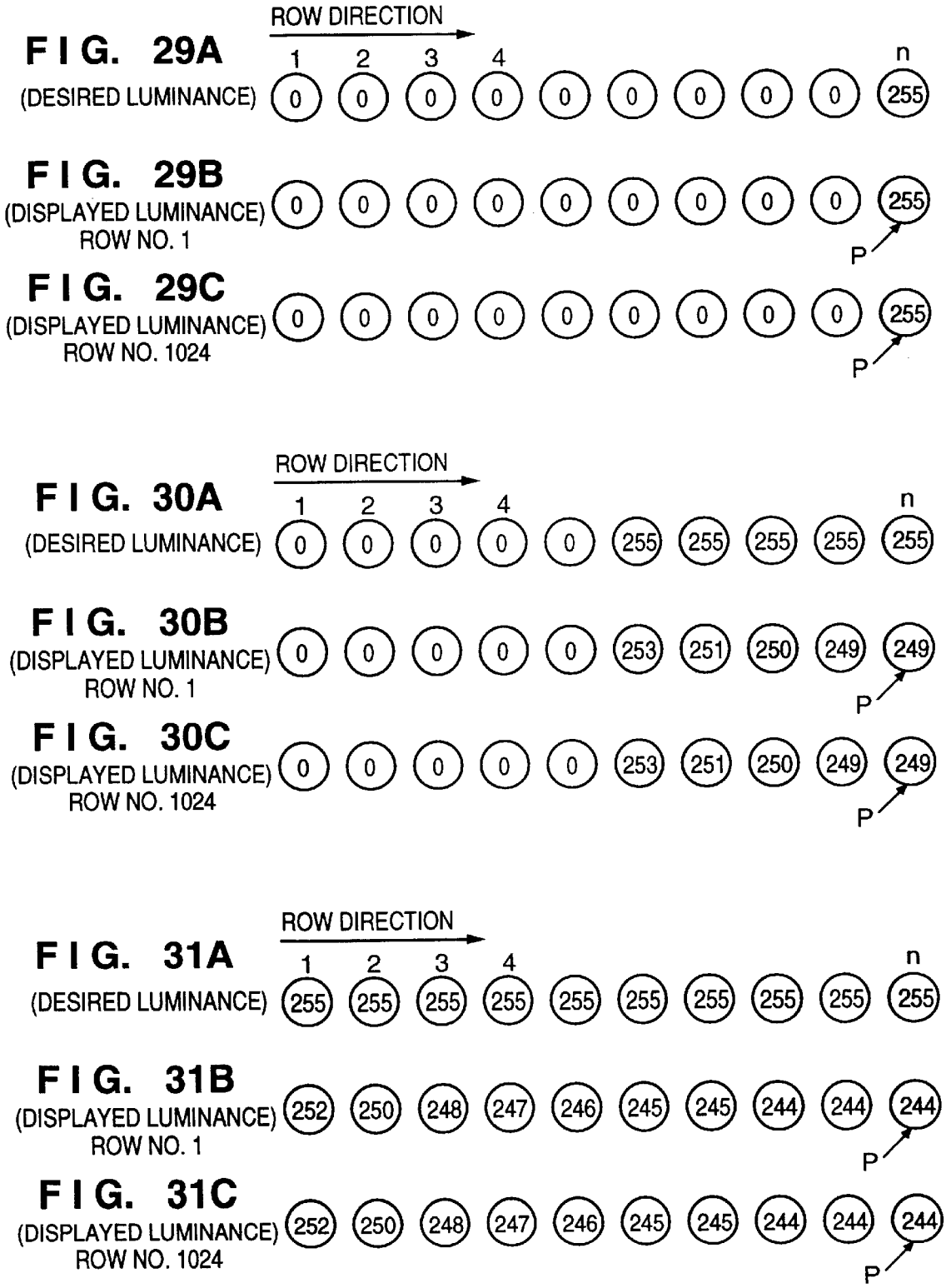
FIGS. 29A~29C are diagrams for describing the effects of the second embodiment.
FIGS. 30A~30C are diagrams for describing the effects of the second embodiment.
FIGS. 31A~31C are diagrams for describing the effects of the second embodiment.

In accordance with this embodiment, effects are obtained in which the deviation between desired luminance and luminance actually displayed is greatly reduced in comparison with the conventional case described in connection with FIGS. 5A~7B. FIGS. 29A~29C, FIGS. 30A~30C and FIGS. 31A~31C are diagrams for illustrating this fact. In order to facilitate the comparison, the luminance of row number 1 actually displayed is shown in FIGS. 29B, 30B and 31B with regard to a case in which luminance identical with that shown in FIGS. 5A, 6A, 7A is desired. Further, the luminance of row number 1024 actually displayed is shown in FIGS. 29C, 30C and 31C. In making the evaluation, a display panel using an electron beam source having a structure the same as that employed when the evaluation shown in FIGS. 5B, 6B, 7B was made was selected and measured.

These Figures clearly show that, with the present invention, it was possible to make the displayed luminance more precise in comparison with the prior art. Moreover, if attention is directed toward the pixels indicated by the arrows P, it will be apparent that even if the desired display pattern is changed, a fluctuation in luminance caused by the change can be reduced. Moreover, a particular feature of this embodiment is that a disparity between different rows can be reduced by a wide margin.

Third Embodiment

Next, a third embodiment of the present invention will be described with reference to the drawings.

First, an arithmetic method for deciding a correction value will be described, then the construction and operation of the electrical circuitry of the third embodiment.

(Method of Calculating Correction Value)

A method of calculating a correction value (correction voltage) which corrects for loss (voltage drop) caused by wiring resistance will now be described. It should be noted that the calculation method described below was applied when the correction rate was measured in the first and second embodiments.

Figure 32:
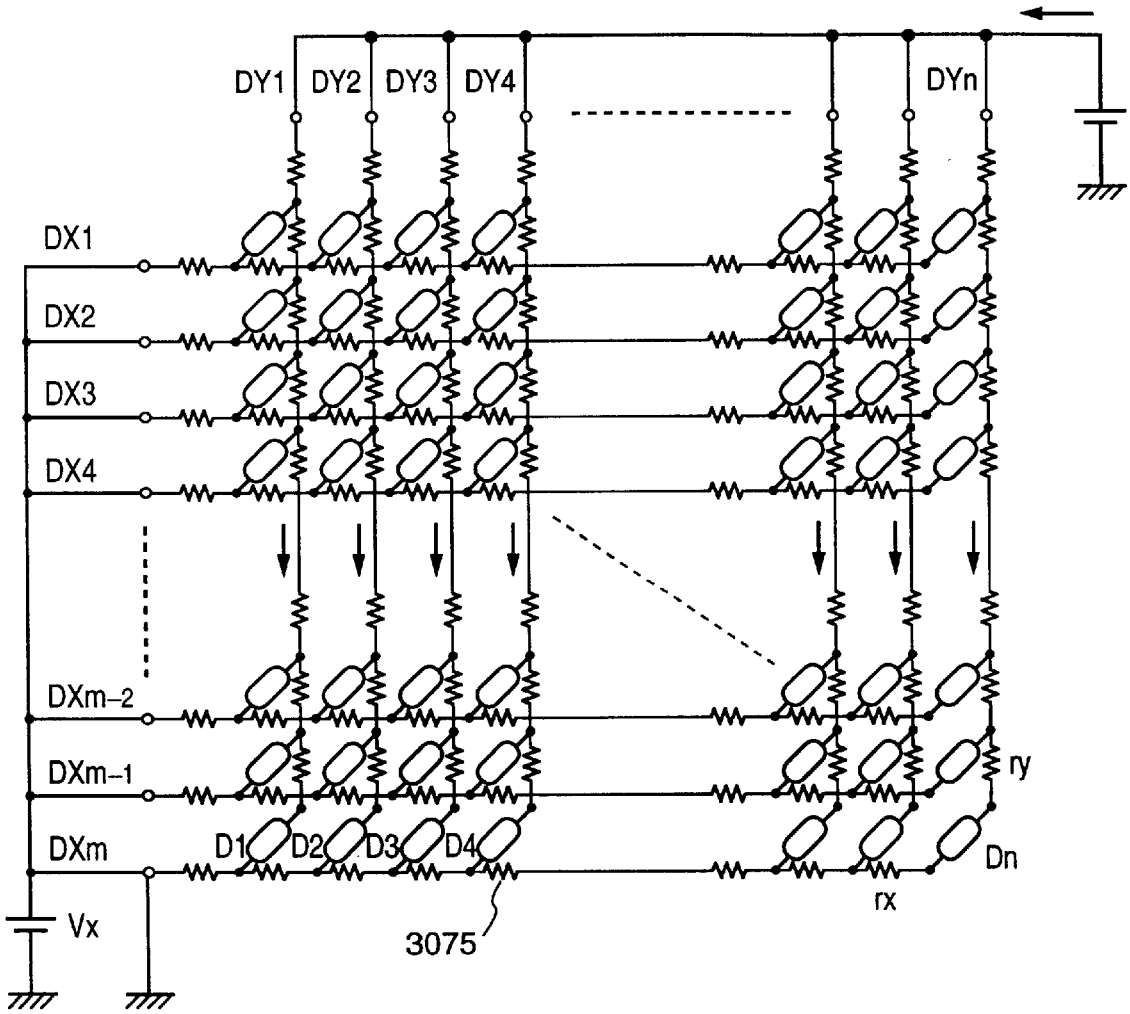
FIG. 32 shows an example of a method of applying voltage in a case where a correction is not applied.

By way of example, the voltage impressed upon each element shown in FIG. 32 declines in dependence upon the amount of current that flows into the wiring. It should be noted that FIG. 32 exemplifies a case in which all cold cathode elements (D1~Dn) of an m-th row of the elements are driven, namely a case for an image in which all pixels of the m-th row are lit. The amount of current which flows through wiring varies if the pattern of the image displayed is changed. More specifically, the amount of voltage drop is uniquely determined by the resistance components of the row and column wiring, the current-voltage characteristic of the cold cathode elements and the image displayed. Accordingly, a voltage value which compensates for the voltage drop can be found from these parameters. In other words, in order to pass a desired current through each element, it will suffice to correct the voltage value, which is to be impressed upon each feeder terminal, in dependence upon the input image.

For example, a voltage which compensates for the voltage drop is found by the computation method indicated by Equation (1) below. A case will be considered in which it is desired to drive the elements in one row simultaneously by applying a voltage E(j) to a row wiring terminal j, and pass an element current I(i,j), which gives a desired amount of electron emission, and which corresponds to the magnitude of the image signal, through an element of a j-th row and i-th column. Here it is assumed that the element (i,j) has an I-V characteristic I=ψi,j (V), a row wiring resistance of Rx(i,j) and a column wiring resistance of Ry(i,j). In a case where the element characteristic at the time of non-selection is approximated by a linear resistance $R_0$(i,j), the voltage Vi(j) to be impressed upon the column wiring terminal i is as follows: when i is on:

$$Vi(j)=[1+Y\mathrm{off}(i,j)-X\mathrm{off}(i,j)]E(j)+[1+Y\mathrm{off}(i,j)]\psi^{-1}i,j(Ii(j))+\Sigma Bi,i'(j)Ii'(j)$$

when i is off:

$$Vi(j)=0$$

where $$Bi,i'(j) \equiv \eta(i,j)\delta i,i' + \xi\ (\min(i',i),j) \quad \text{[Eq. 1]}$$

$$= \begin{cases} \eta\xi(i',j) & (i' < i) \\ \eta(i,j) + \xi(i,j) & (i' = i) \\ \xi(i,j) & (i' > i) \end{cases}$$

$$i'(j) \equiv \begin{cases} I(i',j) & (i' \text{ is on}) \\ 0 & (i' \text{ is off}) \end{cases}$$

$$Xoff(i,j) = \sum_{i'}^{off} \frac{\xi(\min(i',i),j)}{R_0(i',j)}$$

$$Yoff(i,j) = \sum_{j'}^{off} \frac{\eta(\min(i',j),j)}{R_0(i,j')}$$

$$\xi(i,j) \equiv \sum_{i'=1} R_x(j',j)$$

$$\eta(i,j) = \sum_{i'=1} \backslash(\backslash\%\backslash)R_y(i',j)$$

In a case where the lead resistances (the resistances between the feeder terminals and the drive circuitry) of the row and column wiring are Ra and Rb, respectively, and the row and column wiring resistances between elements are constant values $r_x$, $r_y$, respectively, we have $$\xi(i,j) \equiv Ra + ir_x$$

$$\eta(i,j) \equiv Rb + ir_y$$

Further, when the linear resistance $R_0(i,j)$ is large in comparison with the resistance which prevails when an element is selected, the Yoff(i,j), Xoff(i,j) terms are negligible. Therefore, Vi(j) becomes as follows:

$$Vi(j) = \begin{cases} E(j) + \psi^{-1}i,j(Ii(j)) + \sum Bi,i'(j)Ii'(j) & \text{if } i \text{ is on} \\ 0 & \text{if } i \text{ is off} \end{cases} \quad \text{[Eq. 2]}$$

Furthermore, focusing on a case in which i is ON in Equation (2) (namely in a case where a current is flowing into the element), it is seen that the second term on the right side is the voltage, across the element terminals, which applies the current attempted to be passed through the element, and that the third term is a component-dependent upon the wiring resistance. When it is attempted to pass currents I1~In through respective ones of the n elements, this can be expressed by the matrix equation shown in FIG. 33.

The first term on the right side of the matrix shown in FIG. 33 is obtained by multiplying the weighted sum of the row wiring element resistances by the current values (I1~In) of the respective elements. The second term on the right side is obtained by multiplying the lead resistance Ra of the row wiring by the sum (I1+I2+ . . . +In) of the current values of one row. The third term on the right side is obtained by multiplying the current values (I1~In) of the respective elements by the wiring resistance (Rb+jry) up to the element through which current flows, this resistance including the lead resistance of the column wiring.

This signifies that the drop in the applied element voltage, described earlier, is considered by being separated into a component based upon average information, namely the sum of the luminance values of the displayed image in the second term on the right side, a component based upon a subtle discrepancy in the displayed image in the first term on the right side, etc. Accordingly, several terms in this equation can be omitted at the time of calculation depending upon the relationship among the magnitudes of the row wiring resistance rx, row-wiring lead resistance Ra and column-wiring lead resistance Rb. Further, when the current voltage characteristic of an element can be approximated as a linear curve, or in a case where the level of the current flowing into an element does change from element to element, namely a case where the luminance of the display apparatus is controlled based upon electron emission time of the element and not the magnitude of the current that flows into the element, the sum of one row of current values in the second term has a one-to-one relationship with the sum of the image signals.

Accordingly, there are occasions where the calculated value for correction purposes may be replaced by a statistic such as the sum total or average of the image signals.

(Construction and Operation of Electrical Circuitry)

Figure 34:
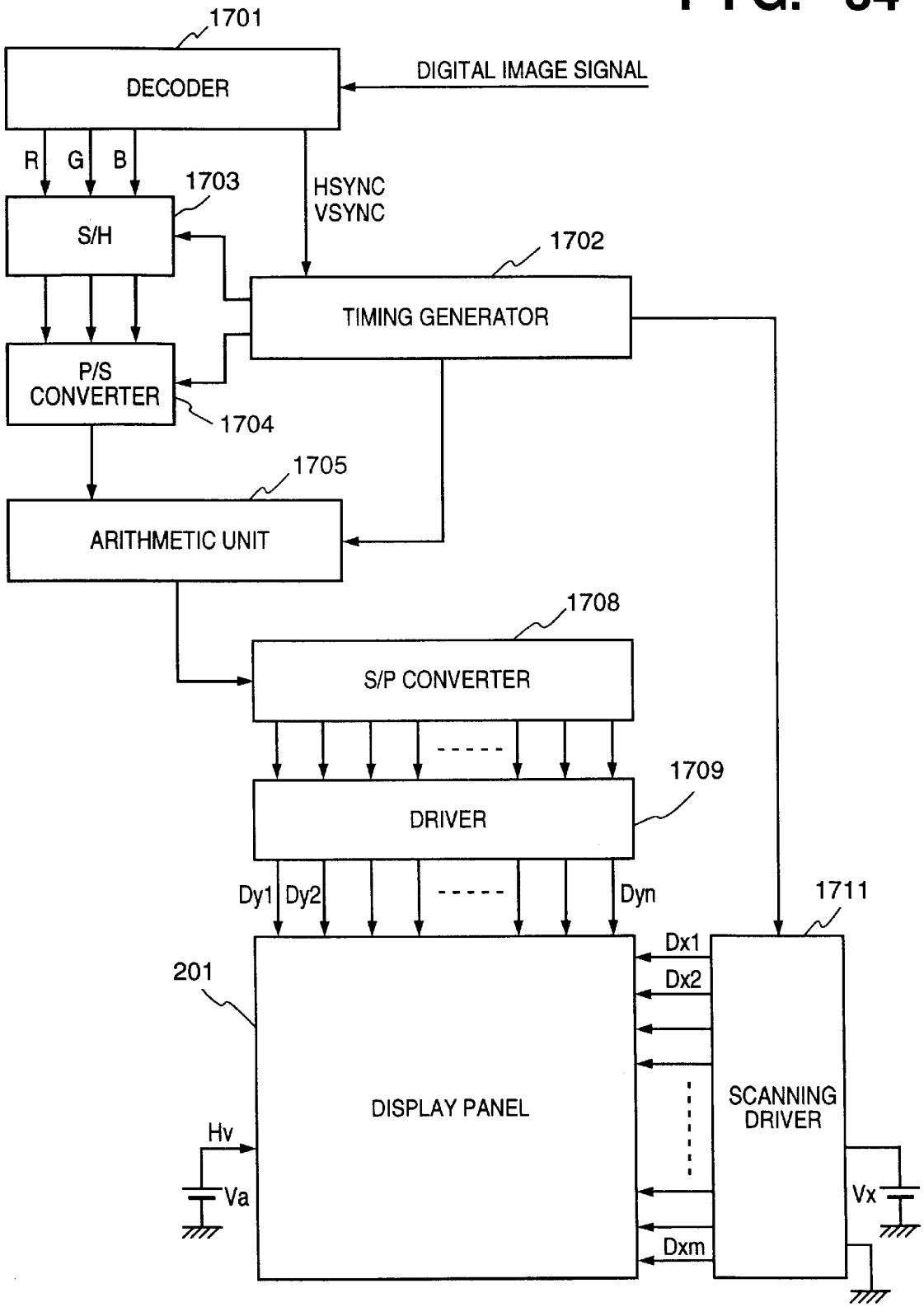
FIG. 34 is a circuit diagram showing the circuit arrangement of a third embodiment of the present invention.

FIG. 34 is a circuit diagram showing the construction of the electrical circuitry. Shown in FIG. 34 are the display panel 201, a decoder 1701, a timing generator 1702, a sample-and-hold circuit 1703, a parallel/serial converter 1704, an arithmetic circuit 1705, a serial/parallel converter 1708, a modulating signal driver 1709 and a scanning signal driver 1711.

A plurality of cold cathode elements arranged in the form of rows and columns are incorporated within the display panel 201. Dx1~Dxm and Dy1~Dyn represent feeder terminals belonging to the m-number of row wires and n-number of column wires, respectively, of matrix wiring. The display panel 201 used is identical with that described earlier in connection with the first embodiment.

The arithmetic circuit 1705 is an example in which the statistic calculating means, correction-value generating means and combining means, which are requisite elements of the invention, are realized by being integrated into one circuit. The serial/parallel converter 1708, modulating signal driver 1709 and scanning signal driver 1711 are an example of means for driving the rows successively one row at a time. It should be noted that since this embodiment relates to an image display apparatus, an externally entered image signal is used as the electron-beam demand information (information relating to the electron-beam output required for each cold cathode element).

In an ordinary image display operation, an entered composite video signal is separated into luminance signals (R, G, B) of the three primary colors, a horizontal synchronizing signal (HSYNC) and a vertical synchronizing signal (VSYNC) by the decoder 1701. The timing generator 1702 generates various timing signals synchronized to the HSYNC and VSYNC signals. The R, G, B luminance signals outputted by the decoder 1701 are sampled and held at a suitable timing by the S/H (sample-and-hold) circuit 1703. The R, G, B signals held in the S/H circuit 1703 are applied to the parallel/serial (P/S) converter 1704, which generates a serial signal arrayed in a numerical order corresponding to the pixel array of the display panel 201. Next, the arithmetic circuit 1705 performs an arithmetic operation on the basis of the serial signal and generates a serial signal compensated for the amount of the voltage drop. This serial signal is further converted to a parallel drive signal for each row by the serial/parallel converting circuit 1708. The driver 1709 produces drive pulses having a voltage corresponding to the intensity of each correction voltage signal. These pulses are supplied to the display panel 201. In the display panel 201 thus supplied with the drive pulses, only cold cathode elements connected to the row selected by the scanning driver 1711 emit electrons for a period of time conforming to the supplied pulse width and voltage value. As a result, electrons bombard the phosphors disposed face plate so that light is emitted by the phosphors. The scanning driver 1711 successively selects the rows, whereby an image is displayed in order one row at a time.

In an cold cathode element (i.e., surface-conduction electron emission element) used in this embodiment, resistance is 7 KΩ at the time of selection and 1 MΩ at the time of non-selection. Therefore, the arithmetic operation can be performed using Equation (2), set forth above. Accordingly, in this embodiment, the arithmetic circuit 1705 is constituted by the arithmetic circuitry shown in the block diagram of FIG. 35.

Figure 35:
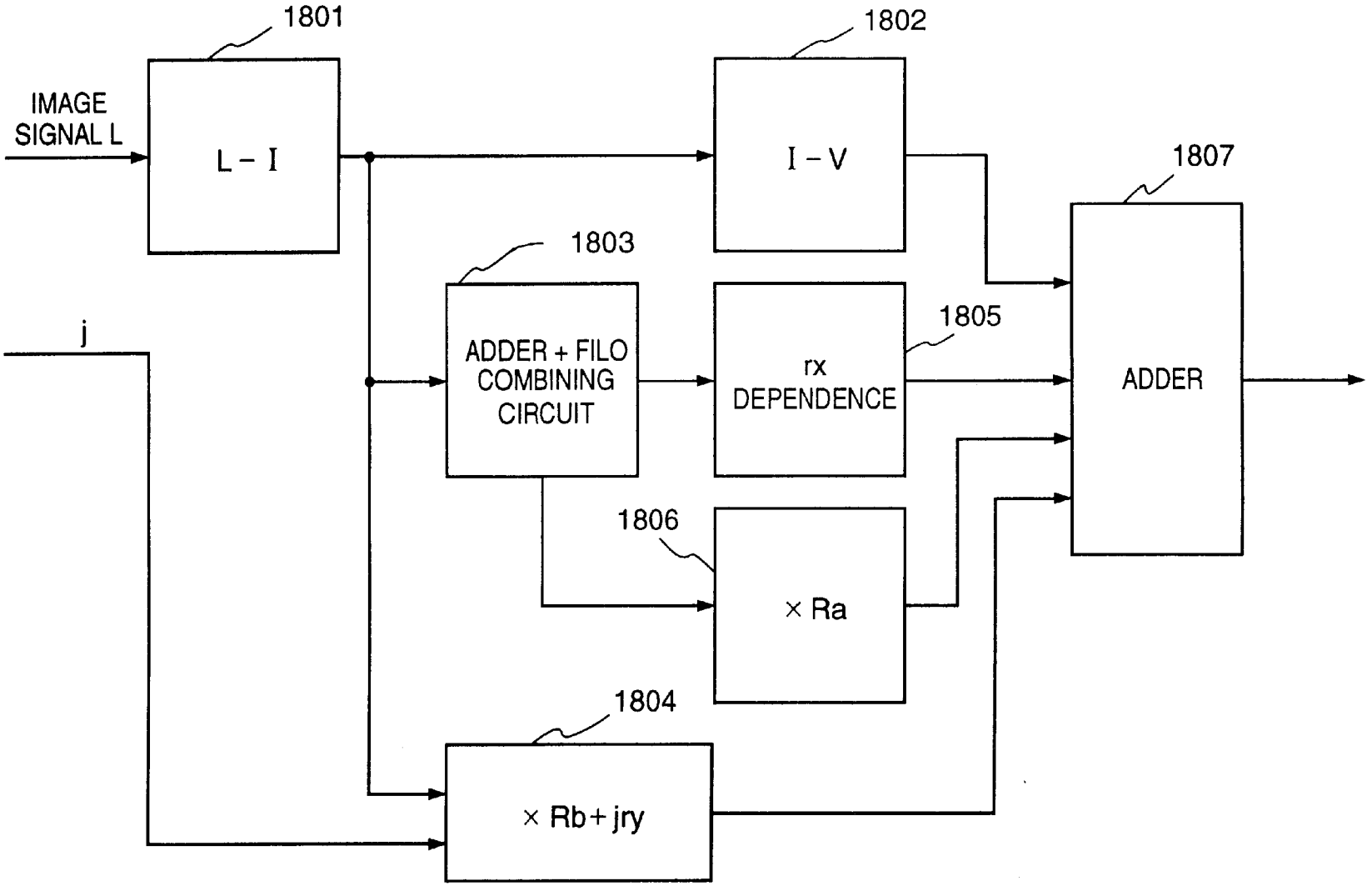
FIG. 35 is a diagram showing the internal construction of an arithmetic unit used in the third embodiment.
Figure 36:
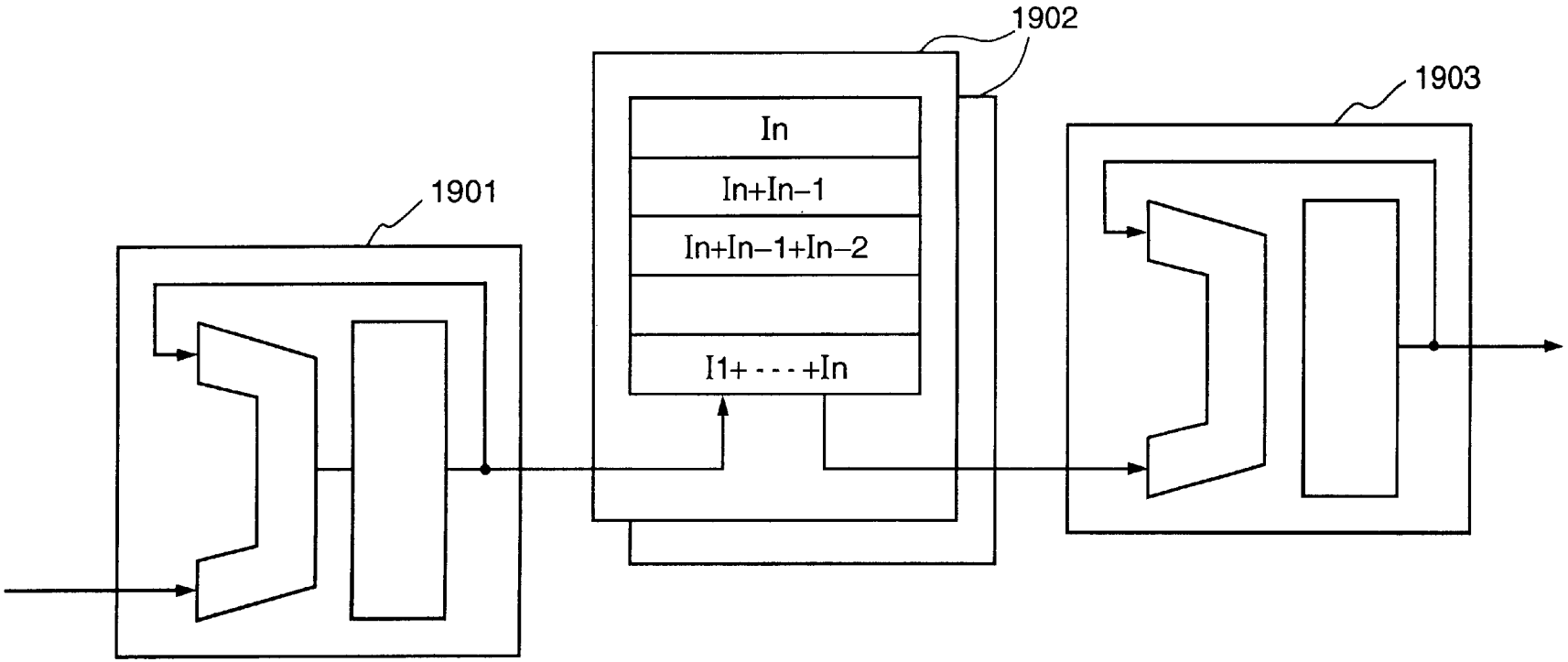
FIG. 36 is a diagram showing the internal construction of a combining circuit used in the third embodiment.

In FIG. 35, an entered image luminance signal L is converted by a look-up table 1801 to a signal I, which corresponds to a current that flows through a surface-conduction electron emission element that gives a luminance L. This signal branches in three directions. In one branch, the signal is converted by a second look-up table 1802 to a signal V corresponding to a voltage that gives a current I. In another branch, the signal enters a multiplying circuit 1804, which obtains the product between this signal and the resistance component Rb of the column wiring. A scanning-line signal j enters the multiplying circuit 1804 and applies weighting to the element resistance. As shown in FIG. 36, a combining circuit 1803 comprises adders 1901, 1903 and a FILO (first in, last out) circuit 1902 and calculates a term dependent upon the row-direction wiring resistance of the matrix equation shown in FIG. 33. The combining circuit 1803 outputs a sum signal indicative of the sum of current of one row and also outputs n-number of I coefficients obtained by the matrix operation of the first term on the right side of the matrix equation of FIG. 33. Of these two outputs, the n-number of coefficients are multiplied by rx in a multiplier 1805. The sum signal of one row is multiplied by Ra in a multiplier 1806.

The outputs of the second look-up table 1802 and multipliers 1804, 1805, 1806 are summed by an adder 1807. This sum signal is an output corresponding to the above-mentioned Equation (2). Thus, a conversion from a digital signal to an analog signal is performed by the driver circuit 1709, and the surface-conduction electron emission elements are driven by this analog signal. As a result, desired currents corresponding to I1~In flow into the surface-conduction electron emission elements. Accordingly, the amounts of electron emission in the elements are rendered uniform, and the amounts of light emission from the phosphors corresponding to the elements become uniform in conformity with the amounts of electrons emitted.

The display apparatus of this embodiment can be applied widely in a television apparatus and in a display apparatus connected directly or indirectly to various image signal sources such as computers, image memories and communication networks. The image display apparatus is well suited to large-screen displays that display images having a large capacity.

The present invention is not limited solely to applications in which there is direct viewing by a human being. The present invention may be applied to a light source of an apparatus which records an image on a recording medium by light, as in the manner of a so-called optical recorder.

In accordance with this embodiment, the deviation between desired luminance and actually displayed luminance can be reduced greatly in comparison with the prior art shown in FIGS. 5A~7B. This effect is equivalent to that for the case in which a correction value is decided in the second embodiment by a formula similar to that of this embodiment. In other words, according to this embodiment, it is possible for displayed luminance to be made much more accurate in comparison with the prior art. Moreover, even if the desired display pattern is changed, a fluctuation in luminance caused thereby can be reduced. The disparity between rows also can be reduced by a wide margin.

It should be noted that the second embodiment is such that all correction values regarding various images are stored in memory. In this embodiment, however, the correction values are calculated by an arithmetic unit. This makes it possible to reduce memory capacity by a wide margin.

Fourth Embodiment (Embodiment of Multifunctional Display Apparatus)

Figure 37:
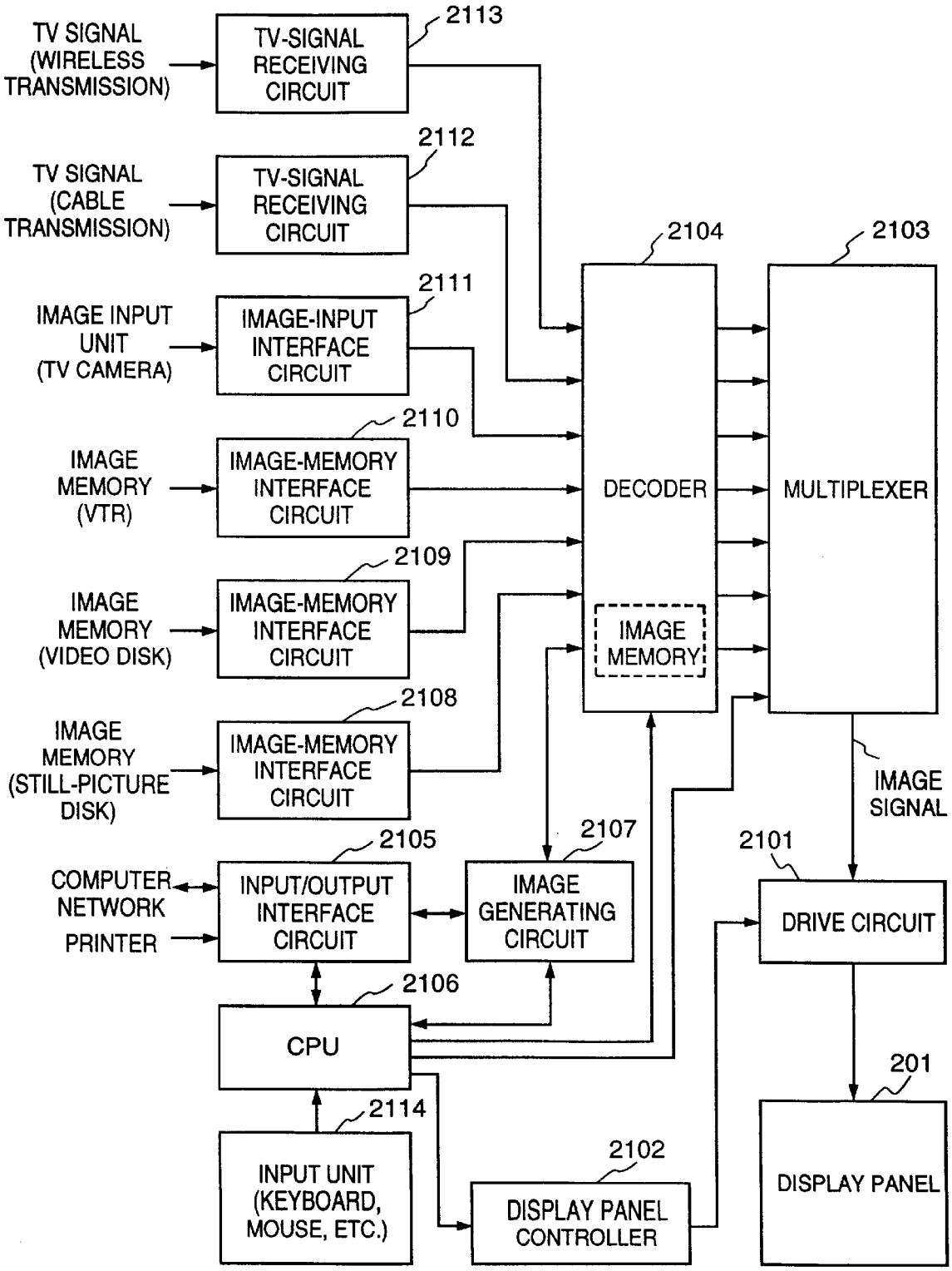
FIG. 37 is a circuit block diagram showing a multifunctional display apparatus according to a fourth embodiment of the present invention.

FIG. 37 is a diagram showing an example of a multifunctional display apparatus constructed in such a manner that image information supplied from various image information sources, the foremost of which is a television (TV) broadcast, can be displayed on a display apparatus according to the first through fourth embodiments.

Shown in the Figure are a display panel 201, a drive circuit 2101 for the display panel, a display controller 2102, a multiplexer 2103, a decoder 2104, an input/output interface circuit 2105, a CPU 2106, an image forming circuit 2107, image-memory interface circuits 2108, 2109 and 2110, an image-input interface circuit 2111, TV-signal receiving circuits 2112, 2113, and an input unit 2114. It should be noted that the circuitry of the first through third embodiments is included in the drive circuit 2101 and display panel 201 of FIG. 37. In a case where the display apparatus of this embodiment receives a signal containing both video information and audio information as in the manner of a television signal, for example, audio is of course reproduced at the same time that video is displayed. However, circuitry and speakers related to the reception, separation, reproduction, processing and storage of audio information not directly related to the features of this invention are not described.

The functions of the various units will be described in line with the flow of the image signal.

First, the TV-signal receiving circuit 2113 receives a TV image signal transmitted using a wireless transmission system that relies upon radio waves, optical communication through space, etc. The system of the TV signals received is not particularly limited. Examples of the systems are the NTSC system, PAL system and SECAM system, etc. A TV signal comprising a greater number of scanning lines (e.g., a so-called high definition TV signal such as one based upon the MUSE system) is a signal source that is ideal for exploiting the advantages of the above-mentioned display panel suited to enlargement of screen area and to an increase in the number of pixels. A TV signal received by the TV-signal receiving circuit 2113 is outputted to the decoder 2104.

The TV-signal receiving circuit 2112 receives the TV image signal transmitted by a cable transmission system using coaxial cable or optical fibers, etc. As in the case of the TV-signal receiving circuit 2113, the system of the received TV signal is not particularly limited. Further, the TV signal received by this circuit also is outputted to the decoder 2104. The image-input interface circuit 2111 is a circuit for accepting an image signal supplied by an image input unit such as a TV camera or image reading scanner. The accepted image signal is outputted to the decoder 2104.

The image-memory interface circuit 2110 accepts an image signal that has been stored in a video tape recorder (hereinafter abbreviated to VTR) and outputs the accepted image signal to the decoder 2104. The image-memory interface circuit 2109 accepts an image signal that has been stored on a video disk and outputs the accepted image signal to the decoder 2104.

The image-memory interface circuit 2108 accepts an image signal from a device storing still-picture data, such as a so-called still-picture disk, and outputs the accepted still-picture data to the decoder 2104. The input/output interface circuit 2105 is a circuit for connecting the display apparatus and an external computer, computer network or output device such as a printer. It is of course possible to input/output image data, character data and graphic information and, depending upon the case, it is possible to input/output control signals and numerical data between the CPU 2106, with which the display apparatus is equipped, and an external unit.

The image generating circuit 2107 is for generating display image data based upon image data and character/graphic information entered from the outside via the input/output interface circuit 2105 or based upon image data character/graphic information outputted by the CPU 2106. By way of example, the circuit is internally provided with a rewritable memory for storing image data or character/graphic information, a read-only memory in which image patterns corresponding to character codes have been stored, and a circuit necessary for generating an image, such as a processor for executing image processing. The display image data generated by the image generating circuit 2107 is outputted to the decoder 2104. In certain cases, however, it is possible to input/output image data relative to an external computer network or printer via an input/output interface circuit 2105.

The CPU 2106 mainly controls the operation of the display apparatus and operations relating to the generation, selection and editing of display images. For example, the CPU outputs a control signal to the multiplexer 2103 to suitably select or combine image signals displayed on the display panel. At this time the CPU generates a control signal for the display panel controller 2102 in conformity with the image signal displayed and suitably controls the operation of the display apparatus, such as the frequency of the frame, the scanning method (interlaced or non-interlaced) and the number of screen scanning lines. Furthermore, the CPU outputs image data and character/graphic information directly to the image generating circuit 2107 or accesses the external computer or memory via the input/output interface circuit 2105 to enter the image data or character/graphic information. It goes without saying that the CPU 2106 may also be used for purposes other than these. For example, the CPU may be directly applied to a function for generating and processing information, as in the manner of a personal computer or word processor. Alternatively, the CPU may be connected to an external computer network via the input/output interface circuit 2105, as mentioned above, so as to perform an operation such as numerical computation in cooperation with external equipment.

The input unit 2114 is for allowing the user to enter instructions, programs or data into the CPU 2106. Examples are a keyboard and mouse or various other input devices such as a joystick, bar code reader, voice recognition unit, etc. The decoder 2104 is a circuit for reversely converting various image signals, which enter from the units 2107~2113, into color signals of the three primary colors or a luminance signal and I, Q signals. It is desired that the decoder 2104 be internally equipped with an image memory, as indicated by the dashed line. This is for the purpose of handling a television signal that requires an image memory when performing the reverse conversion, as in a MUSE system, by way of example. Providing the image memory is advantageous in that display of a still picture is facilitated and in that, in cooperation with the image generating circuit 2107 and CPU 2106, editing and image processing such as thinning out of pixels, interpolation, enlargement, reduction and synthesis are facilitated.

The multiplexer 2103 suitably selects the display image based upon a control signal which enters from the CPU 2106. More specifically, the multiplexer 2103 selects a desired image signal from among the reversely-converted image signals which enter from the decoder 2104 and outputs the selected signal to the drive circuit 2101. In this case, by changing over and selecting the image signals within the display time of one screen, one screen can be divided up into a plurality of areas and images which differ depending upon the area can be displayed as in the manner of a so-called split-screen television. The display panel controller 2102 controls the operation of the drive circuit 2101 based upon the control signal which enters from the CPU 2106.

With regard to the basic operation of the display panel 201, a signal for controlling the operating sequence of a driving power supply (not shown) for the display panel 201 is outputted to the drive circuit 2101, by way of example. In relation to the method of driving the display panel 201, a signal for controlling, say, the frame frequency or scanning method (interlaced or non-interlaced) is outputted to the drive circuit 2101. Further, there is a case in which a control signal relating to adjustment of picture quality, namely luminance of the display image, contrast, tone and sharpness, is outputted to the drive circuit 2101.

The drive circuit 2101 is a circuit for generating a drive signal applied to the display panel 201 and operates based upon the image signal which enters from the multiplexer 2103 and the control signal which enters from the display panel controller 2102.

The functions of the various units are as described above. By using the arrangement shown in FIG. 37, image information which enters from a variety of image information sources can be displayed on the display panel 201 in the display apparatus of this embodiment. Specifically, various image signals, the foremost of which is a television broadcast signal, are reversely converted in the decoder 2104, suitably selected in the multiplexer 2103 and entered into the drive circuit 2101. On the other hand, the display controller 2102 generates a control signal for controlling the operation of the drive circuit 2101 in dependence upon the image signal displayed. On the basis of the aforesaid image signal and control signal, the drive circuit 2101 applies a drive signal to the display panel 201. As a result, an image is displayed on the display panel 201. This series of operations is under the overall control of the CPU 2106.

Further, in the display apparatus of this embodiment, the contribution of the image memory incorporated within the decoder 2104, the image generating circuit 2107 and CPU 2106 make it possible not only to display image information selected from a plurality of items of image information but also to subject the displayed image information to image processing such as enlargement, reduction, rotation, movement, edge emphasis, thinning-out, interpolation, color conversion and vertical-horizontal ratio conversion and to image editing such as synthesis, erasure, connection, substitution and fitting. Further, though not particularly touched upon in the description of this embodiment, it is permissible to provide a special-purpose circuit for performing processing and editing with regard also to audio information in the same manner as the image processing and image editing set forth above.

Accordingly, the display apparatus of this invention is capable of being provided with various functions in a single unit, such as the functions of TV broadcast display equipment, office terminal equipment such as television conference terminal equipment, image editing equipment for handling still pictures and moving pictures, computer terminal equipment and word processors, games, etc. Thus, the display apparatus has wide application for industrial and private use.

FIG. 37 merely shows an example of the construction of a multifunctional display apparatus. However, the apparatus is not limited to this arrangement. For example, circuits relating to functions not necessary for the particular purpose of use may be deleted from the structural elements of FIG. 37. Conversely, depending upon the purpose of use, structural elements may be additionally provided. For example, in a case where the display apparatus is used as a TV telephone, it would be ideal to add a transmitting/receiving circuit inclusive of a television camera, audio microphone, illumination equipment and modem to the structural elements.

As many apparently widely different embodiments of the present invention can be made without departing from the spirit and scope thereof, it is to be understood that the invention is not limited to the specific embodiments thereof except as defined in the appended claims.

What is claimed is:

1. An image display apparatus, comprising:

a plurality of electron emission devices arrayed in a matrix formation;

an image forming material provided to form an image by irradiation of electrons emitted from the plurality of electron emission devices;

a plurality of row wires and column wires provided to wire the plurality of electron emission devices in the matrix formation;

a scanning circuit provided to sequentially supply a scanning signal to the row wires for sequentially selecting the row wires; and a driving signal generator provided to supply driving pulse signals to the plurality of column wires so as to drive electron emission devices connected to the row wire selected by said scanning circuit, wherein the driving pulse signals are corrected by correction values corresponding to a plurality of the column wires to which the driving pulse signals are supplied, to compensate for a voltage drop which depends on an image pattern to be formed, on the row wire selected by said scanning circuit.

2. An apparatus according to claim 1, wherein the correction values further compensate an electric loss due to a resistance of each of the column wires.

3. An apparatus according to claim 1, wherein the electron emission devices are surface-conduction type emitting devices.

4. An apparatus according to claim 1, wherein the image forming material includes a phosphor.

5. An apparatus according to claim 1, wherein the electron emission devices are cold cathode devices.

6. An image display apparatus, comprising:

a plurality of electron emission devices arrayed in a matrix formation;

an image forming material provided to form an image by irradiation of electrons emitted from the plurality of electron emission devices;

a plurality of row wires and column wires provided to wire the plurality of electron emission devices in the matrix formation;

a scanning circuit provided to sequentially supply a scanning signal to the row wires for sequentially selecting the row wires;

a driving signal generator provided to supply driving pulse signals to the plurality of column wires so as to drive electron emission devices connected to the row wire selected by said scanning circuit, wherein the driving pulse signals are corrected by correction values corresponding to a plurality of the column wires to which the driving pulse signals are supplied, and the correction values depend on an image pattern to be formed.

7. An apparatus according to claim 6, further comprising a correction circuit for generating the correction values.

8. An apparatus according to claim 7, wherein said correction circuit includes a memory for storing correction data.

9. An apparatus according to claim 7, wherein said correction circuit has an arithmetic circuit for performing an arithmetic operation to obtain correction data.

10. An apparatus according to claim 6, wherein said electron emitting devices are cold cathode devices.

11. An apparatus according to claim 6, wherein said electron emitting devices are surface conduction type electron emitting devices.

12. An apparatus according to claim 6, wherein the correction values are values to pass a desired current through each of a plurality of electron emitting devices connected to a row wire selected by said scanning circuit.

13. An apparatus according to claim 6, wherein the correction values are values determined based on the sum of luminance data to be applied to at least a plurality of electron emitting devices connected to the row wire selected by said scanning circuit.

14. An apparatus according to claim 6, wherein the correction values are values determined based on an average value of the sum of luminance data to be applied to at least a plurality of electron emitting devices connected to the row wire selected by said scanning circuit.

* * * * *

UNITED STATES PATENT AND TRADEMARK OFFICE

CERTIFICATE OF CORRECTION

PATENT NO. : 6,580,407 B1 
DATED : June 17, 2003
INVENTOR(S) : Noritake Suzuki et al.

It is certified that error appears in the above-identified patent and that said Letters Patent is hereby corrected as shown below:

Title page,
Item [30], Foreign Application Priority Data,
"Feb. 6, 1995 (JP) …….. 7-136986" should read
-- Jun. 2, 1995 (JP) …… 7-136986 --.
Item [56], References Cited, U.S. PATENT DOCUMENTS, "5,701,134 A * 5/1990 Lambert et al." should read -- 5,701,134 A * 12/1997 Lambert et al. --;
FOREIGN PATENT DOCUMENTS, "58-224120 * 6/1982" should read
-- 58-224120 * 6/1983 --.
Item [57], ABSTRACT,
Line 10, "can" should read -- can be --.

Column 5,
Line 26, "statistic quantity" should read -- statistic-quantity --.
Line 32, "values," should read -- values --, and "values" should read -- values, --.

Column 15,
Line 30, "prescribed." should read -- prescribed --.

Column 18,
Line 32, "19A." should read -- 19A.) --.

Column 19,
Line 19, "a 10" should read -- and 10 --.

Column 21,
Line 61, "vth," should read -- Vth, --.

Column 25,
Line 20, "\(\%\)$R_y$(i',j)" should read -- $R_y$(i', j) --.

UNITED STATES PATENT AND TRADEMARK OFFICE

CERTIFICATE OF CORRECTION

PATENT NO. : 6,580,407 B1
DATED : June 17, 2003
INVENTOR(S) : Noritake Suzuki et al.

It is certified that error appears in the above-identified patent and that said Letters Patent is hereby corrected as shown below:

Column 32,
Line 18, “wires;” should read -- wires; and --.

Signed and Sealed this

Sixth Day of April, 2004

JON W. DUDAS
*Acting Director of the United States Patent and Trademark Office*